US012179819B2

(12) United States Patent
Malde et al.

(10) Patent No.: US 12,179,819 B2
(45) Date of Patent: Dec. 31, 2024

(54) MULTI-OBJECTIVE SYSTEMS AND METHODS FOR OPTIMALLY ASSIGNING TRAIN BLOCKS AT A RAILROAD MERCHANDISE YARD

(71) Applicant: BNSF Railway Company, Fort Worth, TX (US)

(72) Inventors: Avnish Kishor Malde, Fort Worth, TX (US); Paul Kuhn, Fort Worth, TX (US); Timothy R. Banks, Galesburg, IL (US); Cory A. Misiewicz, Keller, TX (US); Ross E. Molyneaux, Aledo, TX (US); Felicia R. Mosenfelder, Toulon, IL (US); Tanner R. Wyatt, Haslet, TX (US)

(73) Assignee: BNSF Railway Company, Fort Worth, TX (US)

( * ) Notice: Subject to any disclaimer, the term of this patent is extended or adjusted under 35 U.S.C. 154(b) by 0 days.

(21) Appl. No.: 18/672,747

(22) Filed: May 23, 2024

(65) Prior Publication Data

US 2024/0308555 A1 Sep. 19, 2024

(51) Int. Cl.
*B61L 7/06* (2006.01)
*B61L 21/06* (2006.01)

(52) U.S. Cl.
CPC ..... *B61L 7/06* (2013.01); *B61L 21/06* (2013.01)

(58) Field of Classification Search
CPC ..... B61L 7/06; B61L 21/06
See application file for complete search history.

(56) References Cited

U.S. PATENT DOCUMENTS 6,418,854 B1 7/2002 Kraft
6,804,621 B1 * 10/2004 Pedanckar ..... B61L 25/026 702/85

(Continued)

FOREIGN PATENT DOCUMENTS

CN 109447414 A 3/2019
CN 112100263 A 12/2020

(Continued)

OTHER PUBLICATIONS

Zhang et al.; "Optimization of Classification Track Assignment Considering Block Sequence at Train Marshaling Yard," J. of Advanced Transportation, www.researchgate.net, 11 pages (2018).

(Continued)

*Primary Examiner* — Hussein Elchanti
(74) *Attorney, Agent, or Firm* — Whitaker Chalk Swindle & Schwartz PLLC; Enrique Sanchez, Jr.; Juan Vasquez

(57) ABSTRACT

A method for assigning train blocks at a railroad merchandise yard includes determining, using a first optimization model and historical train block volume data, a first list of train block assignments for a plurality of train blocks and a plurality of classification tracks of a classification bowl. The method further includes displaying the first list of train block assignments generated by the first optimization model if the volume of the train blocks is not greater than the total available track length of the classification tracks. The method further includes determining and displaying, using a second optimization model and the historical train block volume data, a second list of train block assignments for the plurality of train blocks and the plurality of classification tracks of the classification bowl if the volume of the plurality of train blocks is greater than the total available track length of the plurality of classification tracks.

20 Claims, 12 Drawing Sheets

(56) References Cited

U.S. PATENT DOCUMENTS

| | | | | |
|---|---|---|---|---|
| 6,832,204 | B1 | 12/2004 | Doner | |
| 7,657,349 | B2 | 2/2010 | Hawthorne | |
| 7,813,846 | B2 | 10/2010 | Wills et al. | |
| 7,937,193 | B2 | 5/2011 | Philp et al. | |
| 8,332,086 | B2 | 12/2012 | Muinonen et al. | |
| 9,156,483 | B2 | 10/2015 | Cooper et al. | |
| 9,171,345 | B2 | 10/2015 | Reippi | |
| 9,266,543 | B2 * | 2/2016 | Takagi | B61L 25/026 |
| 10,339,584 | B2 | 9/2019 | Brooks et al. | |
| 10,946,880 | B2 * | 3/2021 | Khan | B61L 27/60 |
| 2005/0251299 | A1 * | 11/2005 | Donnelly | B60L 15/20 701/19 |
| 2014/0142791 | A1 * | 5/2014 | Boehni | B61K 9/12 701/19 |
| 2015/0066561 | A1 | 3/2015 | Wills et al. | |
| 2017/0197646 | A1 * | 7/2017 | Shubs, Jr. | B61L 27/40 |
| 2017/0217461 | A1 * | 8/2017 | Echizen | B61L 21/04 |
| 2017/0305448 | A1 * | 10/2017 | Yano | G06F 30/20 |
| 2017/0349191 | A1 * | 12/2017 | Hamada | B61L 25/021 |
| 2018/0050711 | A1 * | 2/2018 | Rice | B61L 15/0081 |
| 2018/0237042 | A1 * | 8/2018 | Angel | B61L 25/025 |
| 2019/0359238 | A1 | 11/2019 | Ding et al. | |
| 2020/0172132 | A1 * | 6/2020 | Kernwein | B61L 27/20 |
| 2020/0189632 | A1 * | 6/2020 | Saxena | B61L 23/007 |
| 2022/0348428 | A1 * | 11/2022 | Aleynikov | B60T 8/1893 |
| 2024/0199101 | A1 * | 6/2024 | Wait | B61L 27/16 |

FOREIGN PATENT DOCUMENTS

| | | | |
|---|---|---|---|
| CN | 115503794 | A | 12/2021 |
| CN | 111242370 | B | 5/2022 |
| CN | 113657653 | B | 4/2023 |
| CN | 112660165 | B | 6/2023 |
| CN | 116700249 | A | 9/2023 |
| CN | 116902039 | A | 10/2023 |
| RU | 2723051 | C1 | 6/2020 |

OTHER PUBLICATIONS

Dirnberger; "PSR and the Digital Transformation fo Rail Yard Planning," https://www.fhwa.dot.gov/planning.freighr_planning/talking_freight/march_2020/talkingfreight3_18_20jd.pdf (Oct. 17, 2020).

Deleplanque et al.; "Train management in freight shunting yards: Formalisation and literature review," IET Intelliget Transport Systems, vol. 16, Issue 10, pp. 1286-1305; Jul. 21, 2022 (2022).

GE, GE Transportation's Digital Solutions; Yard Planner; 2016.

* cited by examiner

600

| 601 | 602 | 603 | 604 | 605 | 606 | 607 | 608 | 609 | 610 |
|---|---|---|---|---|---|---|---|---|---|
| TRIM_LEAD | TRK_NUM | TRK_LGTH_FT | TRAINID | Block_ID | 8th Percentile Volume | Assigned_Volume_at_80_prcnt | Unassigned_Volume_at_80_prcnt | Remaining_Footage_at_80_prcnt | Utilization at 80th percentile volume |
| 124A | 123A | 2625 | TRAIN 4 | 122A | 3109.00 | 2625.00 | 484.00 | 0.00 | 100.00 |
| 124A | 123B | 2634 | TRAIN 4 | 122A | 2674.55 | 2634.00 | 40.55 | 0.00 | 100.00 |
| 124A | 123C | 2757 | TRAIN 4 | 122A | 2799.45 | 2757.00 | 42.45 | 0.00 | 100.00 |
| 124A | 123D | 2834 | TRAIN 5 | 122B | 1162.00 | 1162.00 | 0.00 | 1672.00 | 41.00 |
| 124A | 123E | 2951 | TRAIN 5 | 122C | 3111.97 | 2951.00 | 160.97 | 0.00 | 100.00 |
| 124A | 123F | 3062 | TRAIN 5 | 122C | 3229.03 | 3062.00 | 167.03 | 0.00 | 100.00 |
| 124A | 123G | 2842 | TRAIN 1 | 122D | 3089.00 | 2842.00 | 247.00 | 0.00 | 100.00 |
| 124A | 123H | 2699 | TRAIN 1 | 122E | 3454.00 | 2699.00 | 755.00 | 0.00 | 100.00 |
| 124A | 123I | 2594 | TRAIN 1 | 122F | 1991.34 | 1991.34 | 0.00 | 602.66 | 76.77 |
| 124A | 123J | 2485 | TRAIN 1 | 122F | 1907.66 | 1907.66 | 0.00 | 577.34 | 76.77 |
| 124A | 123K | 2485 | TRAIN 3 | 122G | 2565.34 | 2485.00 | 80.34 | 0.00 | 100.00 |
| 124A | 123L | 2422 | TRAIN 3 | 122H | 1890.00 | 1890.00 | 0.00 | 532.00 | 78.03 |
| 124A | 123M | 2422 | | 122I | 1.73 | 1.73 | 0.00 | 2420.27 | 0.07 |
| 124A | 123N | 2433 | TRAIN 3 | 122J | 2511.66 | 2433.00 | 78.66 | 0.00 | 100.00 |
| 124A | 123O | 2540 | TRAIN 6 | 122K | 1946.58 | 1946.58 | 0.00 | 593.42 | 76.64 |
| 124A | 123P | 2515 | | 122L | 2344.00 | 2344.00 | 0.00 | 171.00 | 93.20 |
| 124A | 123Q | 2515 | TRAIN 6 | 122K | 1927.42 | 1927.42 | 0.00 | 587.58 | 76.64 |
| 124A | 123R | 2354 | | 122M | 370.00 | 370.00 | 0.00 | 1984.00 | 15.72 |
| 124A | 123S | 2246 | TRAIN 6 | 122N | 1750.00 | 1750.00 | 0.00 | 496.00 | 77.92 |
| 124A | 123T | 1975 | | 122O | 269.00 | 269.00 | 0.00 | 1706.00 | 13.62 |
| 124A | 123U | 1975 | | 122P | 129.00 | 129.00 | 0.00 | 1846.00 | 6.53 |

620A

620B

FIG. 6

MULTI-OBJECTIVE SYSTEMS AND METHODS FOR OPTIMALLY ASSIGNING TRAIN BLOCKS AT A RAILROAD MERCHANDISE YARD

TECHNICAL FIELD

This disclosure generally relates to railroad yards, and more specifically to multi-objective systems and methods for optimally assigning train blocks at a railroad merchandise yard.

BACKGROUND

A typical train is composed of one or more locomotives (sometimes referred to as engines) and one or more railcars being pulled and/or pushed by the one or more engines. Trains are typically assembled in a railroad classification yard. In typical operations of a classification yard, hundreds or thousands of rail cars are moved through classification tracks to route each of the railcars to a respectively assigned track, where the railcars are ultimately coupled to their assigned train based upon the train's route and final destination. Once the train is fully assembled, the train then departs the railyard and travels to its destination.

To assemble an outbound train, train cars are decoupled from incoming trains and sorted to various classification tracks of a railroad classification "hump" yard. Typically, each train car is assigned to a specific train block (i.e., a label based on destination, car type, etc.), and each classification track holds only the train cars having a common train block label. The process of assigning train blocks from incoming trains to classification tracks in a hump yard is typically a manual process. For example, users known as Trainmasters and in some cases, Yardmasters must determine which train blocks to assign to which classification tracks in a hump yard. The manual decisions about the assignments of train blocks from incoming trains to specific classification tracks is a complex process that often leads to inefficient and suboptimal decisions.

SUMMARY

The present disclosure achieves technical advantages as systems, methods, and computer-readable storage media that provide functionality for optimally assigning train blocks at a railroad merchandise yard. The present disclosure provides for a system integrated into a practical application with meaningful limitations that may include generating and displaying on an electronic display, using stored historical train block volume data and a first optimization model, a first list of train block assignments for a plurality of train blocks and a plurality of classification tracks of a classification bowl. Other meaningful limitations of the system integrated into a practical application include: determining whether a volume of the plurality of train blocks is greater than a total available track length of the plurality of classification tracks; determining, using a second optimization model and the historical train block volume data, a second list of train block assignments for the plurality of train blocks and the plurality of classification tracks; and displaying the second list of train block assignments generated by the second optimization model on the electronic display.

The present disclosure solves the technological problem of a lack of technical functionality for assigning train blocks at a railroad merchandise yard by providing methods and systems that provide functionality for optimally assigning train blocks at a railroad merchandise yard. The technological solutions provided herein, and missing from conventional systems, are more than a mere application of a manual process to a computerized environment, but rather include functionality to implement a technical process to supplement current manual solutions for assigning train blocks at a railroad merchandise yard by providing a mechanism for optimally and automatically assigning train blocks at a railroad merchandise yard. In doing so, the present disclosure goes well beyond a mere application the manual process to a computer.

Unlike existing solutions where personnel may be required to manually assign train blocks to classification tracks at a railroad merchandise yard, embodiments of this disclosure provide systems and methods that provide functionality for optimally assigning train blocks to classification tracks at a railroad merchandise yard. By providing optimized train block to track assignments for a railyard, the efficiency of railroad switching operations may be increased and availability/efficiency of the railroad track may be increased. For example, the time required to form an outbound train may be greatly decreased, the number of switches may be decreased, the switching distance may be decreased, the amount of fuel required for switching operations may be decreased, and the time to build assignments may be greatly reduced as compared to manual processes. Other technical advantages will be readily apparent to one skilled in the art from the following figures, descriptions, and claims. Moreover, while specific advantages have been enumerated above, various embodiments may include all, some, or none of the enumerated advantages.

In some embodiments, the disclosed models are formulated or otherwise configured to utilize various constraints and objectives in order to perform or execute a designated task (e.g., one or more features for optimally assigning train blocks at a railroad merchandise, in accordance with one or more embodiments of the present disclosure). In other embodiments, the present disclosure includes techniques for implementing and training models (e.g., machine-learning models, artificial intelligence models, algorithmic constructs, optimizers, etc.) for performing or executing a designated task or a series of tasks (e.g., one or more features for train block assignment optimization and historical railroad data analysis, in accordance with one or more embodiments of the present disclosure). The disclosed techniques provide a systematic approach for the training of such models to enhance performance, accuracy, and efficiency in their respective applications. In embodiments, the techniques for training the models can include collecting a set of data from a database, conditioning the set of data to generate a set of conditioned data, and/or generating a set of training data including the collected set of data and/or the conditioned set of data.

In embodiments, that model can undergo a training phase wherein the model may be exposed to the set of training data, such as through an iterative processes of learning in which the model adjusts and optimizes its parameters and algorithms to improve its performance on the designated task or series of tasks. This training phase may configure the model to develop the capability to perform its intended function with a high degree of accuracy and efficiency. In embodiments, the conditioning of the set of data may include modification, transformation, and/or the application of targeted algorithms to prepare the data for training. The conditioning step may be configured to ensure that the set of data is in an optimal state for training the model, resulting in an enhancement of the effectiveness of the model's learning process. These features and techniques not only qualify as patent-eligible features but also introduce substantial improvements to the field of computational modeling. These features are not merely theoretical but represent an integration of a concepts into practical applications that significantly enhance the functionality, reliability, and efficiency of the models developed through these processes.

In embodiments, the present disclosure includes techniques for generating a notification of an event (e.g., an output notification, a user notification, etc.) includes generating an alert that includes information specifying the location of a source of data associated with the event, formatting the alert into data structured according to an information format; and transmitting the formatted alert over a network to a device associated with a receiver based upon a destination address and a transmission schedule. In embodiments, receiving the alert enables a connection from the device associated with the receiver to the data source over the network when the device is connected to the source to retrieve the data associated with the event and causes a viewer application (e.g., a graphical user interface (GUI)) to be activated to display the data associated with the event. These features represent patent eligible features, as these features amount to significantly more than an abstract idea.

Such features, when considered as an ordered combination, amount to significantly more than simply organizing and comparing data. The features address the Internet-centric challenge of alerting a receiver with time sensitive information. This is addressed by transmitting the alert over a network to activate the viewer application, which enables the connection of the device of the receiver to the source over the network to retrieve the data associated with the event. These are meaningful limitations that add more than generally linking the use of an abstract idea (e.g., the general concept of organizing and comparing data) to the Internet, because they solve an Internet-centric problem with a solution that is necessarily rooted in computer technology. These features, when taken as an ordered combination, provide unconventional steps that confine the abstract idea to a particular useful application. Therefore, these features represent patent eligible subject matter.

Moreover, in embodiments, one or more operations and/or functionality of components described herein can be distributed across a plurality of computing systems (e.g., personal computers (PCs), user devices, servers, processors, etc.), such as by implementing the operations over a plurality of computing systems. This distribution can be configured to facilitate the optimal load balancing of requests, which can encompass a wide spectrum of network traffic or data transactions. By leveraging a distributed operational framework, a system implemented in accordance with embodiments of the present disclosure can effectively manage and mitigate potential bottlenecks, ensuring equitable processing distribution and preventing any single device from shouldering an excessive burden. This load balancing approach significantly enhances the overall responsiveness and efficiency of the network, markedly reducing the risk of system overload and ensuring continuous operational uptime. The technical advantages of this distributed load balancing can extend beyond mere efficiency improvements. It introduces a higher degree of fault tolerance within the network, where the failure of a single component does not precipitate a systemic collapse, markedly enhancing system reliability.

Additionally, this distributed configuration promotes a dynamic scalability feature, enabling the system to adapt to varying levels of demand without necessitating substantial infrastructural modifications. The integration of advanced algorithmic strategies for traffic distribution and resource allocation can further refine the load balancing process, ensuring that computational resources are utilized with optimal efficiency and that data flow is maintained at an optimal pace, regardless of the volume or complexity of the requests being processed. Moreover, the practical application of these disclosed features represents a significant technical improvement over traditional centralized systems. Through the integration of the disclosed technology into existing networks, entities can achieve a superior level of service quality, with minimized latency, increased throughput, and enhanced data integrity. The distributed approach of embodiments not only bolster the operational capacity of computing networks but offer a robust framework for the development of future technologies, underscoring its value as a foundational advancement in the field of network computing.

Further, to aid in the load balancing, the computing system can spawn multiple processes and threads to process data concurrently. The speed and efficiency of the computing system can be greatly improved by instantiating more than one process or thread to implement the claimed functionality. However, one skilled in the art of programming will appreciate that use of a single process or thread can also be utilized and is within the scope of the present disclosure.

Accordingly, the present disclosure discloses concepts inextricably tied to computer technology such that the present disclosure provides the technological benefit of implementing functionality to provide efficient and optimized train block to track assignments for a railyard. The systems and techniques of embodiments provide improved systems by providing capabilities to perform functions that are currently performed manually and to perform functions that are currently not possible.

In one particular embodiment, a system includes one or more memory units configured to store historical train block volume data. The system further includes one or more computer processors communicatively coupled to the one or more memory units. The one or more computer processors are configured to access the historical train block volume data. The one or more computer processors are further configured to determine, using a first optimization model and the historical train block volume data, a first list of train block assignments for a plurality of train blocks and a plurality of classification tracks of a classification bowl. The one or more computer processors are further configured to determine whether a volume of the plurality of train blocks is greater than a total available track length of the plurality of classification tracks. The one or more computer processors are further configured to display the first list of train block assignments generated by the first optimization model on an electronic display in response to determining that the volume of the plurality of train blocks is not greater than the total available track length of the plurality of classification tracks. The one or more computer processors are further configured to determine, in response to determining that the volume of the plurality of train blocks is greater than the total available track length of the plurality of classification tracks, a second list of train block assignments for the plurality of train blocks and the plurality of classification tracks using a second optimization model and the historical train block volume data. The one or more computer processors are further configured to display, in response to determining that the volume of the plurality of train blocks is greater than the total available track length of the plurality of classification tracks, the second list of train block assignments generated by the second optimization model on the electronic display.

In another embodiment, a method for assigning train blocks at a railroad merchandise yard includes accessing historical train block volume data. The method further includes determining, using a first optimization model and the historical train block volume data, a first list of train block assignments for a plurality of train blocks and a plurality of classification tracks of a classification bowl. The method further includes determining whether a volume of the plurality of train blocks is greater than a total available track length of the plurality of classification tracks. The method further includes displaying the first list of train block assignments generated by the first optimization model on an electronic display in response to determining that the volume of the plurality of train blocks is not greater than the total available track length of the plurality of classification tracks. The method further includes determining, using a second optimization model and the historical train block volume data, a second list of train block assignments for the plurality of train blocks and the plurality of classification tracks in response to determining that the volume of the plurality of train blocks is greater than the total available track length of the plurality of classification tracks. The method further includes displaying, in response to determining that the volume of the plurality of train blocks is greater than the total available track length of the plurality of classification tracks, the second list of train block assignments generated by the second optimization model on the electronic display.

In another embodiment, one or more computer-readable non-transitory storage media embodies instructions that, when executed by a processor, cause the processor to perform operations that include historical train block volume data. The operations further include determining, using a first optimization model and the historical train block volume data, a first list of train block assignments for a plurality of train blocks and a plurality of classification tracks of a classification bowl. The operations further include determining whether a volume of the plurality of train blocks is greater than a total available track length of the plurality of classification tracks. The operations further include displaying the first list of train block assignments generated by the first optimization model on an electronic display in response to determining that the volume of the plurality of train blocks is not greater than the total available track length of the plurality of classification tracks. The operations further include determining, using a second optimization model and the historical train block volume data, a second list of train block assignments for the plurality of train blocks and the plurality of classification tracks in response to determining that the volume of the plurality of train blocks is greater than the total available track length of the plurality of classification tracks. The operations further include displaying, in response to determining that the volume of the plurality of train blocks is greater than the total available track length of the plurality of classification tracks, the second list of train block assignments generated by the second optimization model on the electronic display.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present disclosure, reference is now made to the following descriptions taken in conjunction with the accompanying drawings, in which:

FIG. 6 illustrates block-to-track assignments that may be generated by the systems and methods presented herein, according to particular embodiments.

Figure 1:
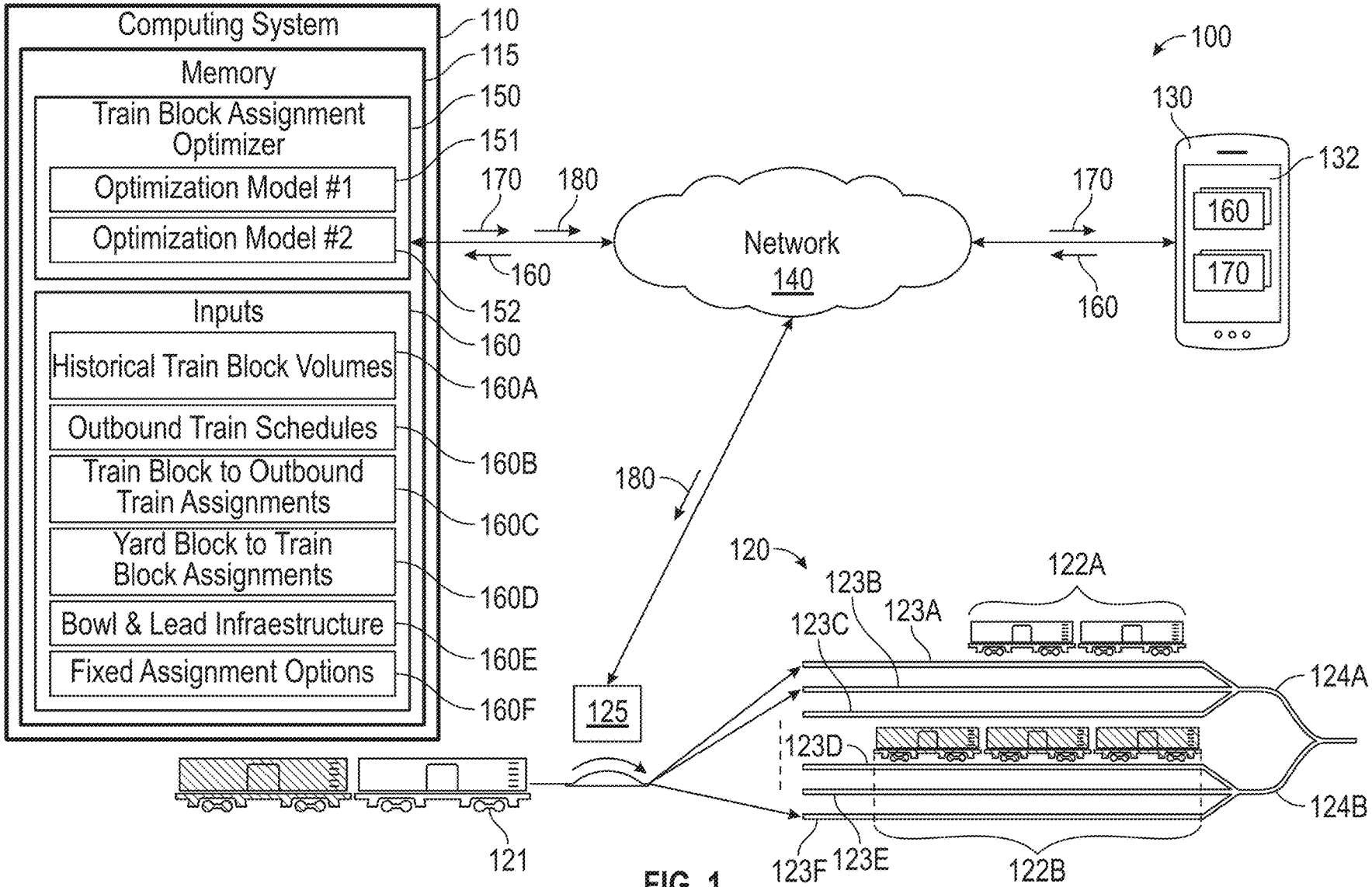
FIG. 1 is a diagram illustrating a train block assignment optimization system, according to particular embodiments.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

The disclosure presented in the following written description and the various features and advantageous details thereof, are explained more fully with reference to the non-limiting examples included in the accompanying drawings and as detailed in the description. Descriptions of well-known components have been omitted to not unnecessarily obscure the principal features described herein. The examples used in the following description are intended to facilitate an understanding of the ways in which the disclosure can be implemented and practiced. A person of ordinary skill in the art would read this disclosure to mean that any suitable combination of the functionality or exemplary embodiments below could be combined to achieve the subject matter claimed. The disclosure includes either a representative number of species falling within the scope of the genus or structural features common to the members of the genus so that one of ordinary skill in the art can recognize the members of the genus. Accordingly, these examples should not be construed as limiting the scope of the claims.

A person of ordinary skill in the art would understand that any system claims presented herein encompass all of the elements and limitations disclosed therein, and as such, require that each system claim be viewed as a whole. Any reasonably foreseeable items functionally related to the claims are also relevant. The Examiner, after having obtained a thorough understanding of the disclosure and claims of the present application has searched the prior art as disclosed in patents and other published documents, i.e., nonpatent literature. Therefore, the issuance of this patent is evidence that: the elements and limitations presented in the claims are enabled by the specification and drawings, the issued claims are directed toward patent-eligible subject matter, and the prior art fails to disclose or teach the claims as a whole, such that the issued claims of this patent are patentable under the applicable laws and rules of this country.

A typical train is composed of one or more locomotives (sometimes referred to as engines) and one or more railcars being pulled and/or pushed by the one or more engines. Trains are typically assembled in a railroad classification yard. In typical operations of a classification yard, hundreds or thousands of rail cars are moved through classification tracks to route each of the railcars to a respectively assigned track, where the railcars are ultimately coupled to their assigned train based upon the train's route and final destination. Once the train is fully assembled, the train then departs the railyard and travels to its destination.

To assemble an outbound train, train cars are decoupled from incoming trains and sorted to various classification tracks of a railroad classification "hump" yard. Typically, each train car is assigned to a specific train block (i.e., a label based on destination, car type, etc.), and each classification track holds only the train cars having a common train block label. The process of assigning train blocks from incoming trains to classification tracks in a hump yard is typically a manual process. For example, users known as Trainmasters and in some cases, Yardmasters must determine which train blocks to assign to which classification tracks in a hump yard. The manual decisions about the assignments of train blocks from incoming trains to specific classification tracks is a complex process that often leads to inefficient and suboptimal decisions.

To address these and other problems with assigning train blocks from incoming trains to specific classification tracks, the disclosed embodiments provide multi-objective systems and methods for optimally assigning train blocks at a railroad merchandise yard. In some embodiments, the disclosed systems and methods utilize two different optimization models to optimally assign train blocks at a railroad merchandise yard while attempting to simultaneously satisfy multiple objectives.

FIG. 1 is a diagram illustrating a train block assignment optimization system 100, according to particular embodiments. Train block assignment optimization system 100 includes a computing system 110, a client system 130, and a network 140. Client system 130 is communicatively coupled with computing system 110 using any appropriate wired or wireless communication system or network (e.g., network 140). Client system 130 includes an electronic display for displaying a user interface 132. User interface 132 display various information and user-selectable elements that permit a user to provide one or more optimization model inputs 160 to train block assignment optimizer 150 executed by computing system 110 and to view one or more optimization model outputs 170 generated by train block assignment optimizer 150. Optimization model outputs 170 provided by train block assignment optimizer 150 may be used to assign train blocks 122 (e.g., 122A and 122B) to classification tracks 123 (e.g., 123A-123F) of classification yard 120, as described in more detail herein. In some embodiments, computing system 110 electronically communicates one or more switching signals 180 (e.g., either wired or wirelessly) to hump yard switching equipment 125 to automatically sort train blocks 122 to classification tracks 123 according to optimization model outputs 170 of train block assignment optimizer 150.

In general, train block assignment optimization system 100 utilizes train block assignment optimizer 150 to provide optimization model outputs 170 (i.e., a pareto chart 170A, block-to-track assignments 170B, pull lead assignments 170C, and a track utilization 170D) for assigning train blocks 122 (e.g., 122A and 122B) to classification tracks 123 (e.g., 123A-123F) of classification yard 120. To do so, some embodiments of train block assignment optimizer 150 utilizes two different optimization models: a first optimization model 151 and a second optimization model 152. Train block assignment optimizer 150 may first utilize first optimization model 151 to determine a first list of train block assignments for train blocks 122 and classification tracks 123 of classification yard 120 (e.g., a classification bowl). If the solution is feasible (e.g., if a volume of the train blocks 122 is less than a total available track length of classification tracks 123), the results of first optimization model 151 may be utilized. However, if the solution of first optimization model 151 is not feasible (e.g., if a volume of the train blocks 122 is greater than a total available track length of classification tracks 123), train block assignment optimizer 150 may generate optimization model outputs 170 using second optimization model 152. Second optimization model 152 may have relaxed constraints from first optimization model 151, as discussed in more detail herein. As a result, assignments of train blocks 122 to classification tracks 123 within classification yard 120 may be optimized and be more efficient than typical operations where a Trainmaster manually decides train block 122 assignments within classification yard 120.

Computing system 110 may be any appropriate computing system in any suitable physical form. As example and not by way of limitation, computing system 110 may be an embedded computer system, a system-on-chip (SOC), a single-board computer system (SBC) (such as, for example, a computer-on-module (COM) or system-on-module (SOM)), a desktop computer system, a laptop or notebook computer system, a mainframe, a mesh of computer systems, a mobile telephone, a personal digital assistant (PDA), a server, a tablet computer system, an augmented/virtual reality device, or a combination of two or more of these. Where appropriate, computing system 110 may include one or more computer systems; be unitary or distributed; span multiple locations; span multiple machines; span multiple data centers; or reside in a cloud, which may include one or more cloud components in one or more networks. Where appropriate, computing system 110 may perform without substantial spatial or temporal limitation one or more steps of one or more methods described or illustrated herein. As an example, and not by way of limitation, computing system 110 may perform in real time or in batch mode one or more steps of one or more methods described or illustrated herein. Computing system 110 may perform at different times or at different locations one or more steps of one or more methods described or illustrated herein, where appropriate. A particular example of a computing system 110 is described in reference to FIG. 12.

Computing system 110 includes one or more memory units/devices 115 (collectively herein, "memory 115") that may store train block assignment optimizer 150 and optimization model inputs 160. Train block assignment optimizer 150 may be a software module/application utilized by computing system 110 to provide optimization model outputs 170 and switching signals 180 for efficiently assigning train blocks 122 to classification tracks 123 of classification yard 120, as described herein. Train block assignment optimizer 150 represents any suitable set of instructions, logic, or code embodied in a computer-readable storage medium. For example, train block assignment optimizer 150 may be embodied in memory 115, a disk, a CD, or a flash drive. In particular embodiments, train block assignment optimizer 150 may include instructions (e.g., a software application) executable by a computer processor to perform some or all of the functions described herein. In some embodiments, train block assignment optimizer 150 includes first optimization model 151 and second optimization model 152 which are described in more detail herein.

Classification yard 120 is a collection of connected railroad tracks for storing and sorting railcars 121. In some embodiments, classification yard 120 is a "hump" yard that is designed to classify railcars 121 into common train blocks 122. Classification yard 120 may be composed of various sub-yards that work together to facilitate the classification of railcars 121 into common train blocks 122 on classification tracks 123. For example, classification yard 120 may include a receiving yard, a hump, a bowl, multiple pull leads 124, and a departure yard. The receiving yard is a storage location for inbound trains and serves as a buffer for downstream processes. Inbound trains that need classification are broken up and prepared for sorting in the receiving yard. The hump works in concert with a series of automated switches and retarders (e.g., hump yard switching equipment 125) to allow gravity to direct railcars 121 to their desired locations in the bowl. The bowl includes multiple classification tracks 123. Each classification track 123 typically holds railcars 121 assigned to a single specific train block 122. The bowl helps sort railcars 121 into different classification tracks 123 based on their destination and acts as a holding location to allow time for the aggregation of block volume. Pull leads 124 are the track connections between the bowl and the departure yard. Yard crews will typically pull multiple classification tracks 123 from the bowl to build an outbound train and then move the outbound train to the departure yard. The pull leads 124 are where these railcars 121 are first combined to construct the outbound train. The departure yard acts as a staging location for an outbound train prior to departure from the terminal.

Railcar 121 is any possible type of railcar that may be coupled to a train. Block 122 is a group of railcars 121. In some embodiments, railcars 121 within a block 122 may originate from disparate origins and may be destined for disparate destinations. A block 122 originating from a location can be composed of railcars 121 whose final destinations are different and could have originated from different locations. When railcars 121 arrive to an intermediate railyard 120, the block 122 may be broken up and railcars 121 from different trains may be re-blocked based on train schedules.

Hump yard switching equipment 125 includes equipment or devises within classification yard 120 that direct train blocks 122 (i.e., railcars 121) to specific classification tracks 123. In some embodiments, hump yard switching equipment 125 includes automatic track switches and retarders that operate to switch railcars 121 onto specific classification tracks 123. In some embodiments, computing system 110 is electronically coupled to hump yard switching equipment 125 using any wired or wireless technology via network 140. In general, computing system 110 sends switching signals 180 to hump yard switching equipment 125 in order to automatically move train blocks 122 to their assigned classification tracks 123 according to optimization model outputs 170 of train block assignment optimizer 150.

Client system 130 is any appropriate user device for communicating with components of computing system 110 over network 140 (e.g., the internet). In particular embodiments, client system 130 may be an electronic device including hardware, software, or embedded logic components or a combination of two or more such components and capable of carrying out the appropriate functionalities implemented or supported by client system 130. As an example, and not by way of limitation, a client system 130 may include a computer system (e.g., computer system 1200) such as a desktop computer, notebook or laptop computer, netbook, a tablet computer, e-book reader, GPS device, camera, personal digital assistant (PDA), handheld electronic device, cellular telephone, smartphone, smartwatch, augmented/virtual reality device such as wearable computer glasses, other suitable electronic device, or any suitable combination thereof. This disclosure contemplates any suitable client system 130. A client system 130 may enable a network user at client system 130 to access network 140. A client system 130 may enable a user to communicate with other users at other client systems 130. Client system 130 may include an electronic display that displays graphical user interface 132, a processor such processor 1202, and memory such as memory 1204.

Network 140 allows communication between and amongst the various components of train block assignment optimization system 100. This disclosure contemplates network 140 being any suitable network operable to facilitate communication between the components of railcar switching optimization system 100. Network 140 may include any interconnecting system capable of transmitting audio, video, signals, data, messages, or any combination of the preceding. Network 140 may include all or a portion of a local area network (LAN), a wide area network (WAN), an overlay network, a software-defined network (SDN), a virtual private network (VPN), a packet data network (e.g., the Internet), a mobile telephone network (e.g., cellular networks, such as 4G or 5G), a Plain Old Telephone (POT) network, a wireless data network (e.g., WiFi, WiGig, WiMax, etc.), a Long Term Evolution (LTE) network, a Universal Mobile Telecommunications System (UMTS) network, a peer-to-peer (P2P) network, a Bluetooth network, a Near Field Communication network, a Zigbee network, and/or any other suitable network.

Train block assignment optimizer 150 uses one or more optimization model inputs 160 to produce one or more optimization model outputs 170. Train block assignment optimizer 150 considers both the constraints of each sub-yard (e.g., arrival yard, classification yard, and departure yard) as well as interactions between the sub-yards. Train block assignment optimizer 150 is a multi-objective optimization model that considers interactions and constraints across the hump yard, particularly regarding the bowl and pull leads 124. In some embodiments, objectives of train block assignment optimizer 150 include one or more of: minimization of conflicts of pull leads 124, efficient utilization of bowl capacity, minimization of switch distance, minimization of the number of trains spread across multiple pull leads 124, and minimization of the number of "swing" tracks assigned in the middle of the train blocks 122 belonging to an outbound train. Each of these objectives is discussed in more detail below.

A first objective of some embodiments of train block assignment optimizer 150 is the minimization of conflicts of pull leads 124. Hump yards typically have multiple pull leads 124 that can become a constraint point for throughput. In an optimal state, parallel processing can occur on multiple pull leads 124 at any instant. Train block assignment optimizer 150 attempts to spread out the required lead utilization (i.e., trains built simultaneously) across time to maximize the opportunity for parallel processing. This may allow for more optimal building of trains. For example, a first train may be built by a first crew at 06:30, and a second train may be planned to be built by a second crew at 07:00. Ideally, these two trains would be built from two different pull leads 124 so that the two crews could work in parallel. Some embodiments of train block assignment optimizer 150 may consider all outbound trains and minimize conflicts across all pull leads 124.

A second objective of some embodiments of train block assignment optimizer 150 is the efficient utilization of bowl capacity/volume. The bowl of classification yard 120 has constraints in both the total amount of footage available (e.g., the total combined track length of classification tracks 123 within the bowl) and in the number of classification tracks 123 available. Some embodiments of train block assignment optimizer 150 minimize the amount of unassigned volume for the bowl. As an illustrative example, suppose that a first train block 122A has 2200 feet of expected traffic (i.e., the combined length of all railcars 121 that are assigned to the first train block 122A is 2200 feet). If classification track 123A that is 2000 feet in length is assigned to first train block 122A, then 200 feet is left unassigned. If one 2000-foot classification track 123 track and another 1000-foot classification track 123 is assigned to first train block 122A, then 0 feet first train block 122A is left unassigned while 800 track feet is expected to be left unutilized. If one 3000-foot classification track 123 is assigned to first train block 122A, then 0 feet of first train block 122A is left unassigned while 800 track feet is expected to be left unutilized. In this scenario, however, only one classification track 123 has been utilized and a second classification track 123 is available for another train block 122 (e.g., train block 122B). Some embodiments of train block assignment optimizer 150 search through and analyze these combinations in order to determine an outcome that accommodates all train blocks 122 while minimizing any unassigned feet of expected traffic of train blocks 122 and overflow.

A third objective of some embodiments of train block assignment optimizer 150 is the minimization of switch distance. In general, all train blocks 122 belonging to any given outbound train should be near one another in the bowl. For example, all railcars 121 belonging to the same train block 122 should be on the same classification track 123 or adjacent classification tracks 123 (e.g., all railcars 121 of train block 122A should be on classification track 123A and all railcars 121 of train block 122B should be on classification track 123D). Some embodiments of train block assignment optimizer 150 assign train blocks 122 such that the distance between common train blocks 122 belonging to the same outbound train is minimized.

A fourth objective of some embodiments of train block assignment optimizer 150 is to minimize the number of trains spread across multiple pull leads 124. For example, consider a scenario where a first outbound train carries train blocks 122A and train blocks 122B. To save resources such as time and energy, some embodiments of train block assignment optimizer 150 attempt to minimize or avoid having crews travel between different pull leads 124 to build the first outbound train by avoiding assigning train blocks 122A and train blocks 122B to two different pull leads 124.

A fifth objective of some embodiments of train block assignment optimizer 150 is to minimize the number of swing tracks assigned in middle of the train blocks 122 belonging to an outbound train. In general, a swing track is a classification track 123 that is left unassigned in order to accommodate unexpected volume of railcars 121. In scenarios where more track length of classification tracks 123 is available than required to accommodate the total volume of train blocks 122 to a predetermined percentile (e.g., at the $80^{th}$ percentile), some embodiments of train block assignment optimizer 150 attempt to optimally place swing tracks in the bowl. For example, some embodiments of train block assignment optimizer 150 assign unused classification tracks 123 as swing tracks such that the swing tracks are placed in between two different outbound trains and not in between the train blocks 122 of an outbound train. As a specific example in FIG. 1, consider a scenario where train blocks 122A are assigned to a first outbound train and train blocks 122B are assigned to a second outbound train. Furthermore, the volumes of train block 122A and train block 122B are such that each requires two classification tracks 123. As a result, two classification tracks 123 are left unoccupied within classification yard 120. In this scenario, train block assignment optimizer 150 assigns the two classification tracks 123 as swing tracks and places the swing tracks between the two different outbound trains. Furthermore, train block assignment optimizer 150 assigns the swing tracks in order to avoid placing the swing tracks between the two classification tracks 123 of train blocks 122A and avoids placing the swing tracks between the two classification tracks 123 of train blocks 122B. In this specific example, train blocks 122A would be assigned to classification tracks 123A-B, train blocks 122B would be assigned to classification tracks 123E-F, and classification tracks 123C-D would be assigned as the swing tracks.

In some embodiments, train block assignment optimizer 150 utilizes two different optimization models to generate optimization model outputs 170: first optimization model 151 and second optimization model 152. Example methods of utilizing first optimization model 151 and second optimization model 152 to generate one or more optimization model outputs 170 are discussed in more detail in reference to FIGS. 9-11. First optimization model 151 and second optimization model 152 are each is described in more detail below.

In some embodiments, train block assignment optimizer 150 utilizes first optimization model 151. In general, some embodiments of first optimization model 151 minimize an amount of total distance a plurality of pull engines must travel to build a plurality of outbound trains, minimize a total number of conflicting pull leads 124, minimize a total number of outbound trains present in multiple pull leads 124, minimize a number of swing tracks assigned in between train blocks 122 belonging to a same outbound train, and maximize a total number of assigned swing tracks. In some embodiments, first optimization model 151 utilizes the set notations as shown in TABLE 1 below:

TABLE 1

| Set Notations for First Optimization Model 151 |
|---|
| I = Set of all blocks |
| i = Element of set I |
| J = Set of all tracks |
| j = Element of set J |
| j' = Element of set J |
| K = Sequence of all trains departing a station ordered by their departure time |
| k = An element of sequence K |
| $k_a$ = Element at index 'a' of sequence K |
| N = Set of all groups |
| n = element of set N |
| $\kappa_k$ = Set of blocks that belong to train 'k' |
| $i_k$ = An element of set $\kappa_k$ |
| $v_n$ = Set of tracks that belong to group 'n' |
| $j_n$ = An element of set $v_n$ |

In some embodiments, first optimization model 151 utilizes the input parameters as shown in TABLE 2 below:

TABLE 2

| Input Parameters for First Optimization Model 151 |
|---|
| $B_i$ = Number of cars arriving daily for block 'i' |
| $C_j$ = Maximum of track 'j' |
| $D_{j,j'}$ = Distance of track 'j' from track 'j'' |
| M = Big − M |
| K = Fixed trains in same lead for consolidation opportunities |
| Λ = Fixed lead assignment |
| T = Fixed track assignment |

In some embodiments, first optimization model 151 utilizes the decision variables as shown in TABLE 3 below:

TABLE 3

| Decision Variables for First Optimization Model 151 |
|---|
| $x_{i,j}$ = 1, if block 'i' is assigned to track 'j', otherwise 0 |
| $t_{k,j}$ = 1, if train 'k' has any of its block on track 'j', otherwise 0 |
| $y_{j,j',k}$ = 1, If train 'k' has blocks on track 'j' and 'j'', otherwise 0 |
| $g_{k,n}$ = 1, if train 'k'as any of its block in group 'n', otherwise 0 |
| $z_{k_a,k_b,n}$ = 1, If train '$k_a$' and train '$k_b$' are in the same group 'n', otherwise 0 |
| $w_{n,n',k}$ = 1, If train 'k' has blocks in group 'n' and 'n'', otherwise 0 |
| $swing_{k,j}$ = 0, if no train − block for train 'k' is assigned to track j |
| $int_swing_{k,j}$ = 1, if '$swing_{k,j}$ = 1', '$t_{k,j-1}$ = 1', and '$t_{k,j+1}$ = 1' |

In some embodiments, first optimization model 151 minimizes an amount of total distance a plurality of pull engines must travel to build a plurality of outbound trains using the following formula:

$$\sum_{\forall k}\sum_{\forall j}\sum_{\forall j'} D_{j,j'} * y_{j,j',k}$$

In some embodiments, first optimization model 151 minimizes a total number of conflicting pull leads 124 using the following formula:

$$\sum_{\forall a=1,\ldots,|K|-1}\ \sum_{\forall b=a+1,\ldots,min\{a+|N|-1,|K|\}}\ \sum_{\forall n} z_{k_a,k_b n}$$

In some embodiments, first optimization model 151 minimizes a total number of outbound trains present in multiple pull leads 124 using the following formula:

$$\sum_{\forall n\in N}\ \sum_{\forall n'\in N, n\neq n'}\ \sum_{\forall k} z_{k_a,k_b n}$$

In some embodiments, first optimization model 151 minimizes a number of swing tracks assigned in between train blocks 122 belonging to a same outbound train using the following formula:

$$\sum_{\forall j}\sum_{\forall k} \text{int_swing}_{j,k}$$

In some embodiments, first optimization model 151 is subject to the items in the following list:

1. A single train block 122 assigned to a single classification tracks 123:

$$\sum_{\forall i} x_{i,j} \leq 1 \ldots \forall\ j$$

2. The length of the allocated classification tracks 123 to all train blocks 122 should be greater than the length of the train blocks 122:

$$\sum_{\forall j} C_j * x_{i,j} \geq B_i \ldots \forall\ i$$

3. Tracking the classification tracks 123 on which the train blocks 122 for a train 'k' are on:

$$t_{k,j} >= x_{i,j} \ldots \forall\ k, \forall\ i \in \kappa_k,\ \&\ \forall\ j$$

4. Tracking the movement of pull engines that travelled from track to track to build a train 'k':

$$y_{j,j',k} \geq t_{k,j} + t_{k,j'} - 1 \ldots \forall j, j' \in J, \forall j' < j \,\&\, \forall k$$

$$y_{j,j',k} \leq t_{k,j} \ldots \forall j, j' \in J, \forall j' < j \,\&\, \forall k$$

$$y_{j,j',k} \leq t_{k,j'} \ldots \forall j, j' \in J, \forall j' < j \,\&\, \forall k$$

5. Tracking the pull leads 124 in which the train 'k' blocks are in:

$$g_{k,n} >= t_{k,j_n} \ldots \forall j_n \in v_n, \forall n \in N, \,\&\, \forall k$$

6. Keeping track of whether any of the |N| consecutive departing trains are assigned to the same pull lead 124:

$$z_{k_a,k_b,n} \geq g_{k_a,n} + g_{k_b,n} - 1 \ldots \forall a = 1, \ldots, |K| - 1, \forall b = a + 1, \ldots, \min\{a + |N| - 1, |K|\}, \,\&\, \forall n \in N$$

$$z_{k_a,k_b,n} \leq g_{k_a,n} \ldots \forall a = 1, \ldots, |K| - 1, \forall b = a + 1, \ldots, \min\{a + |N| - 1, \ldots, |K|\}, \,\&\, \forall n \in N$$

$$z_{k_a,k_b,n} \leq g_{k_b,n} \ldots \forall a = 1, \ldots, |K| - 1, \forall b = a + 1, \ldots, \min\{a + |N| - 1, |K|\}, \,\&\, \forall n \in N$$

7. Keeping track of trains whose train blocks 122 are assigned to multiple pull leads 124:

$$w_{n,n',k} \geq g_{k,n} + g_{k,n'} - 1 \ldots \forall n, n' \in N, n \neq n', \forall k$$

$$w_{n,n',k} \leq g_{k,n} \ldots \forall n, n' \in N, n \neq n', \forall k$$

$$w_{n,n',k} \leq g_{k,n'} \ldots \forall n, n' \in N, n \neq n', \forall k$$

8. Fixing two trains in the same lead assignments:

$$g_{k,n} = g_{k',n} \ldots \forall k, k' \in K, \forall n \in N$$

9. Fixed lead assignments:

$$g_{k_\alpha,n_\alpha} = 1 \ldots \forall k_\alpha, n_\alpha \in A$$

10. Fixed track assignments:

$$x_{i_\tau,j_\tau} = 1 \ldots \forall i_\tau, j_\tau \in T$$

In some situations, the second constraint above (i.e., the length of the allocated classification tracks 123 to all train blocks 122 should be greater than the length of the train blocks 122) is unable to be satisfied (i.e., a solution is not "feasible") by train block assignment optimizer 150 when utilizing first optimization model 151. That is, the volume of train blocks 122 to be assigned to classification tracks 123 is greater than the total available track length of classification tracks 123. If train block assignment optimizer 150 determines that this constraint cannot be satisfied, train block assignment optimizer 150 may convert this constraint to a soft constraint (i.e., train block assignment optimizer 150 minimizes the violation of this constraint or the amount of unassigned block length). The formulation for converting this constraint to a soft constraint is provided in second optimization model 152. In other words, train block assignment optimizer 150 may first apply first optimization model 151 and determine if a feasible solution can be obtained (i.e., determine if the length of the allocated classification tracks 123 to all train blocks 122 is greater than the length of the train blocks 122). If a feasible solution can be obtained, optimization model outputs 170 from first optimization model 151 are returned to the user and may be used for generating switching signals 180. On the other hand, if a feasible solution cannot be obtained using first optimization model 151 (i.e., if the length of the allocated classification tracks 123 to all train blocks 122 is less than the length of the train blocks 122), train block assignment optimizer 150 utilizes second optimization model 152 to return a feasible optimal solution to the user and to generate switching signals 180. Second optimization model 152 is described in more detail below.

In some embodiments, train block assignment optimizer 150 utilizes second optimization model 152. In general, some embodiments of second optimization model 152 minimize an amount of total distance a plurality of pull engines must travel to build a plurality of outbound trains, minimize a total number of conflicting pull leads 124, minimize a total number of outbound trains present in multiple pull leads 124, and minimize a volume of unassigned train blocks 122. In some embodiments, second optimization model 152 utilizes the set notations as shown in TABLE 4 below:

TABLE 4

| Set Notations for Second Optimization Model 152 |
|---|
| I = Set of all blocks |
| i = Element of set I |
| J = Set of all tracks |
| j = Element of set J |
| j' = Element of set J |
| K = Sequence of all trains departing a station ordered by their departure time |
| k = An element of sequence K |
| $k_a$ = Element at index 'a' of sequence K |
| N = Set of all groups |
| n = element of set N |
| $\kappa_k$ = Set of blocks that belong to train 'k' |
| $i_k$ = An element of set $\kappa_k$ |
| $v_n$ = Set of tracks that belong to group 'n' |
| $j_n$ = An element of set $v_n$ |

In some embodiments, second optimization model 152 utilizes the input parameters as shown in TABLE 5 below:

TABLE 5

| Input Parameters for Second Optimization Model 152 |
|---|
| $B_i$ = Average number of cars arriving daily for block 'i' |
| $C_j$ = Maximum cars track 'j' can accomodate |
| $D_{j,j'}$ = Distance of track 'j' from track 'j'' |
| M = Big − M |
| K = Fixed trains in same lead for consolidation opportunities |
| Λ = Fixed lead assignment |
| T = Fixed track assignment |

In some embodiments, second optimization model 152 utilizes the decision variables as shown in TABLE 6 below:

TABLE 6

| Decision Variables for Second Optimization Model 152 |
|---|
| $x_{i,j}$ = 1, if block 'i' is assigned to track 'j', otherwise 0 |
| $t_{k,j}$ = 1, if train 'k' has any of its block on track 'j', otherwise 0 |
| $y_{j,j',k}$ = 1, if train 'k' has blocks on track 'j' and 'j'', otherwise 0 |
| $g_{k,n}$ = 1, if train 'k'as any of its block in group 'n', otherwise 0 |
| $z_{k_a,k_b,n}$ = 1, if train '$k_a$' and train '$k_b$' are in the same group 'n', otherwise 0 |
| $u_i$ = Unassigned volume of block 'i' |

In some embodiments, second optimization model 152 minimizes an amount of total distance a plurality of pull engines must travel to build a plurality of outbound trains using the following formula:

$$\sum_{\forall k}\sum_{\forall j}\sum_{\forall j'} D_{j,j'} * y_{j,j',k}$$

In some embodiments, second optimization model 152 minimizes a total number of conflicting pull leads 124 assigned to train using the following formula:

$$\sum_{\forall a=1,\ldots,|K|-1}\ \sum_{\forall b=a+1,\ldots,min\{a+|N|-1,|K|\}}\ \sum_{\forall n} z_{k_a,k_b,n}$$

In some embodiments, second optimization model 152 minimizes a total number of outbound trains present in multiple pull leads 124 using the following formula:

$$\sum_{\forall n\in N}\ \sum_{\forall n'\in N, n\neq n'}\ \sum_{\forall k} z_{k_a,k_b,n}$$

In some embodiments, second optimization model 152 minimizes a volume of unassigned train blocks 122 using the following formula:

$$\sum_{\forall i} u_i$$

In some embodiments, second optimization model 152 is subject to the items in the following list:

1. A single train block 122 assigned to a single classification tracks 123:

$$\sum_{\forall i} x_{i,j} \leq 1 \ \ldots\ \forall j$$

2. The length of the allocated classification tracks 123 to all train blocks 122 should be greater than the length of the train blocks 122:

$$\sum_{\forall j} C_j * x_{i,j} + u_i \geq B_i \ \ldots\ \forall i$$

3. Tracking the classification tracks 123 on which the train blocks 122 for a train 'k' are on:

$$t_{k,j} >= x_{i,j} \ \ldots\ \forall k, \forall i \in \kappa_k, \ \&\forall j$$

4. Tracking the movement of pull engines that travelled from track to track to build a train 'k':

$$y_{j,j',k} \geq t_{k,j} + t_{k,j'} - 1 \ \ldots\ \forall j, j' \in J, \forall j' < j \ \&\ \forall k$$

$$y_{j,j',k} \leq t_{k,j} \ \ldots\ \forall j, j' \in J, \forall j' < j \ \&\ \forall k$$

$$y_{j,j',k} \leq t_{k,j'} \ \ldots\ \forall j, j' \in J, \forall j' < j \ \&\ \forall k$$

5. Tracking the pull leads 124 in which the train 'k' blocks are in:

$$g_{k,n} >= t_{k,j_n} \ \ldots\ \forall j_n \in v_n, \forall n \in N, \ \&\forall k$$

6. Keeping track of whether any of the |N| consecutive departing trains are assigned to the same pull lead 124:

$$z_{k_a,k_b,n} \geq g_{k_a,n} + g_{k_b,n} - 1 \ \ldots\ \forall a = 1, \ldots, |K| - 1, \quad \forall b = a+1, \ldots, \min\{a+|N|-1, |K|\}, \ \&\forall n \in N$$

$$z_{k_a,k_b,n} \leq g_{k_a,n} \ \ldots\ \forall a = 1, \ldots, |K| - 1, \quad \forall b = a+1, \ldots, \min\{a+|N|-1, |K|\}, \ \&\forall n \in N$$

$$z_{k_a,k_b,n} \leq g_{k_b,n} \ \ldots\ \forall a = 1, \ldots, |K| - 1, \quad \forall b = a+1, \ldots, \min\{a+|N|-1, |K|\}, \ \&\forall n \in N$$

7. Keeping track of trains whose train blocks 122 are assigned to multiple pull leads 124:

$$w_{n,n',k} \geq g_{k,n} + g_{k,n'} - 1 \ \ldots\ \forall n, n' \in N, n \neq n', \forall k$$

$$w_{n,n',k} \leq g_{k,n} \ \ldots\ \forall n, n' \in N, n \neq n', \forall k$$

$$w_{n,n',k} \leq g_{k,n'} \ \ldots\ \forall n, n' \in N, n \neq n', \forall k$$

8. Fixing two trains in same lead assignments:

$$g_{k,n} = g_{k',n} \ \ldots\ \forall k, k' \in K, \forall n \in N$$

9. Fixed lead assignments:

$$g_{k_\alpha,n_\alpha} = 1 \ \ldots\ \forall k_\alpha, n_\alpha \in A$$

10. Fixed track assignments:

$$x_{i_\tau,j_\tau} = 1 \ \ldots\ \forall i_\tau, j_\tau \in T$$

Optimization model inputs 160 are various inputs that train block assignment optimizer 150 utilizes to generate optimization model outputs 170. In some embodiments, optimization model inputs 160 include historical train block volumes 160A, outbound train schedules 160B, train block to outbound train assignments 160C, yard block to train block assignments 160D, bowl and lead assignments 160E, and fixed assignment options 160F. In some embodiments, optimization model inputs 160 are stored in one or more computer systems and are retrieved and stored in memory 115 of computing system 110. In some embodiments, optimization model inputs 160 are provided by client system 130. For example, one or more optimization model inputs 160 may be retrieved from a remote computer system and displayed on user interface 132 of client system 130. In this way, a user may view and edit optimization model inputs 160 prior to utilization by train block assignment optimizer 150. Specific optimization model inputs 160 that may be utilized by certain embodiments of train block assignment optimization system 100 are discussed in more detail below and with respect to FIGS. 2-4.

Figure 2:
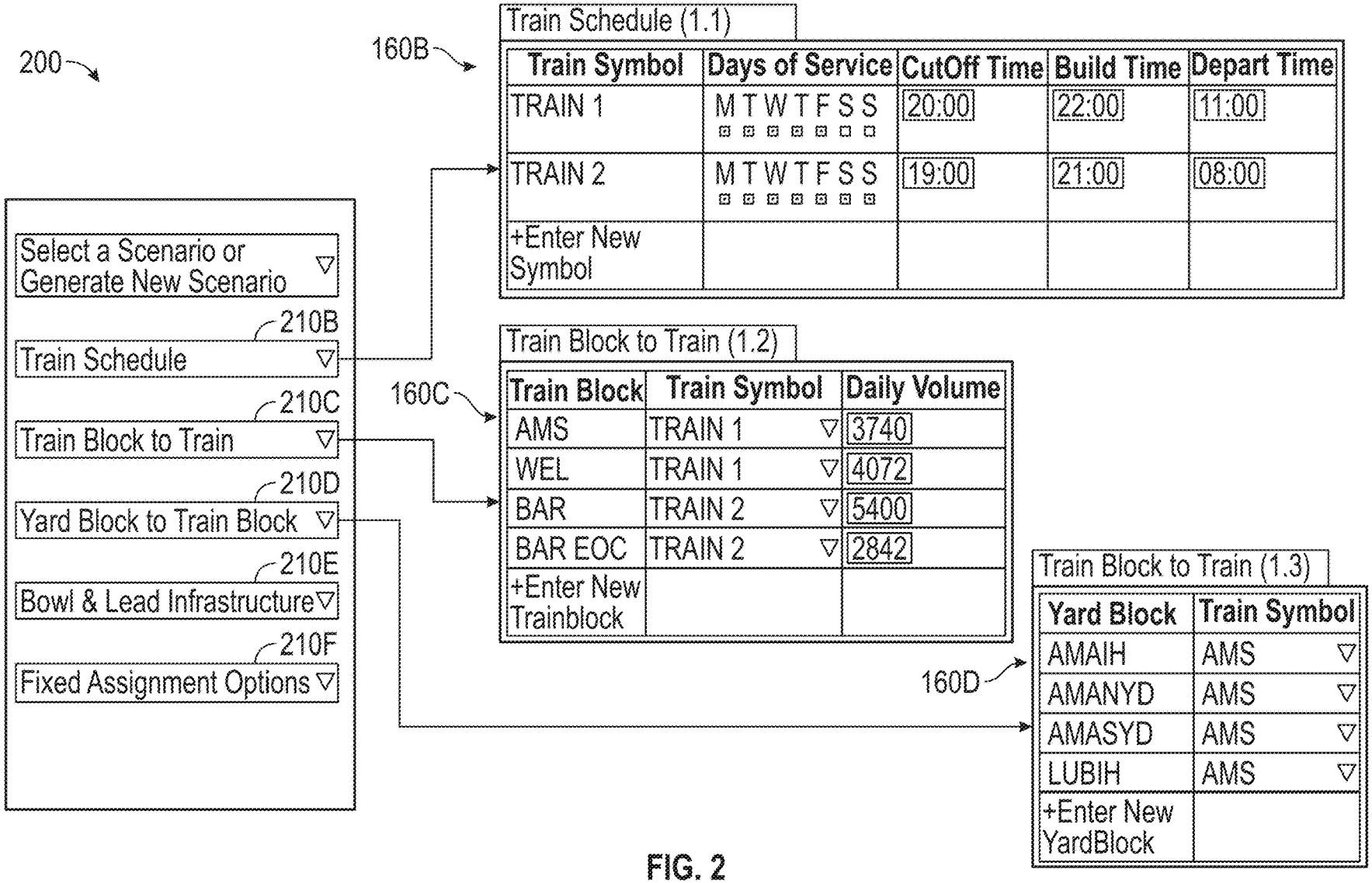
FIGS. 2-4 illustrate user interfaces displaying various optimization model inputs that may be used by the systems and methods presented herein, according to particular embodiments.
Figure 3:
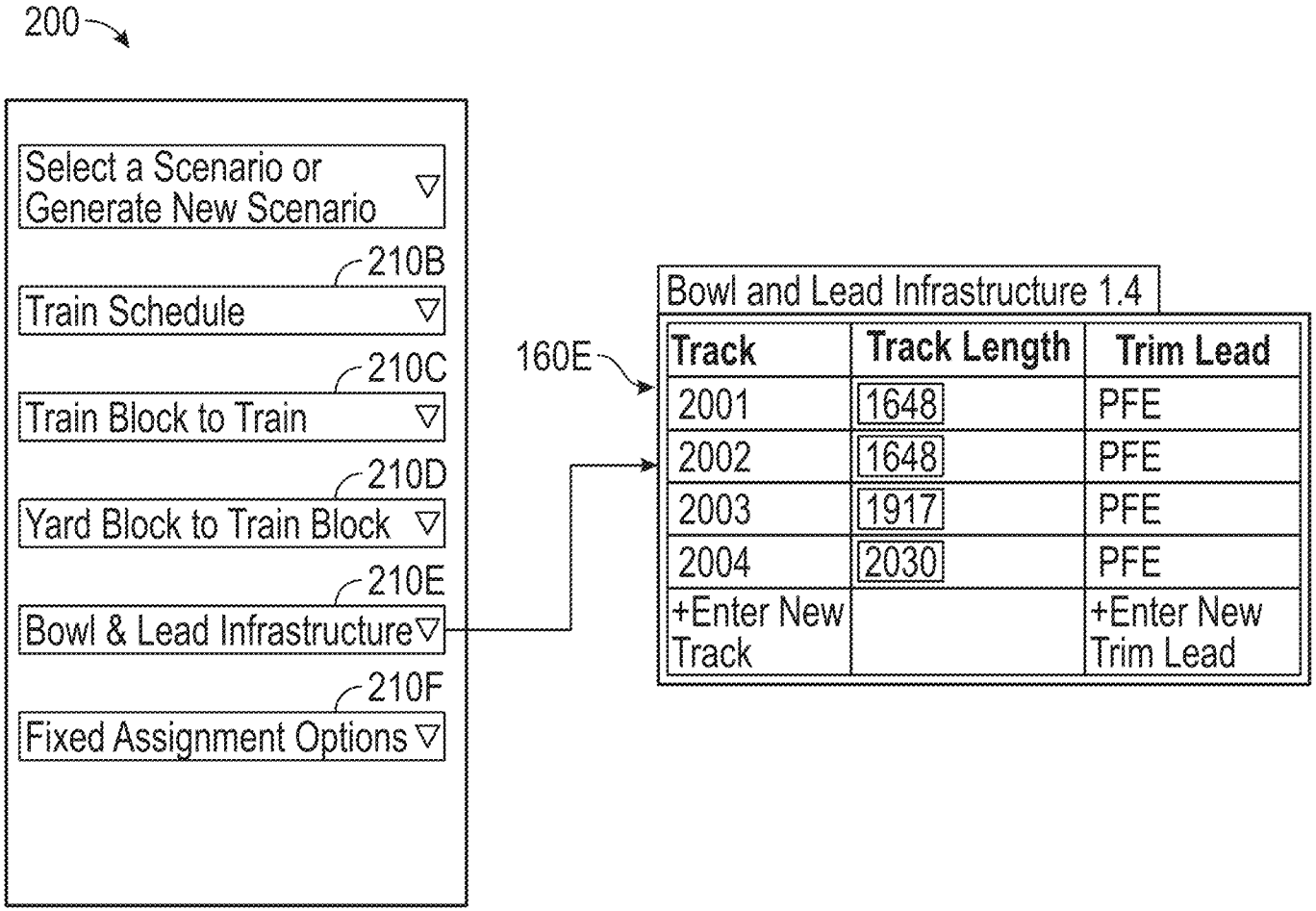
Figure 4:
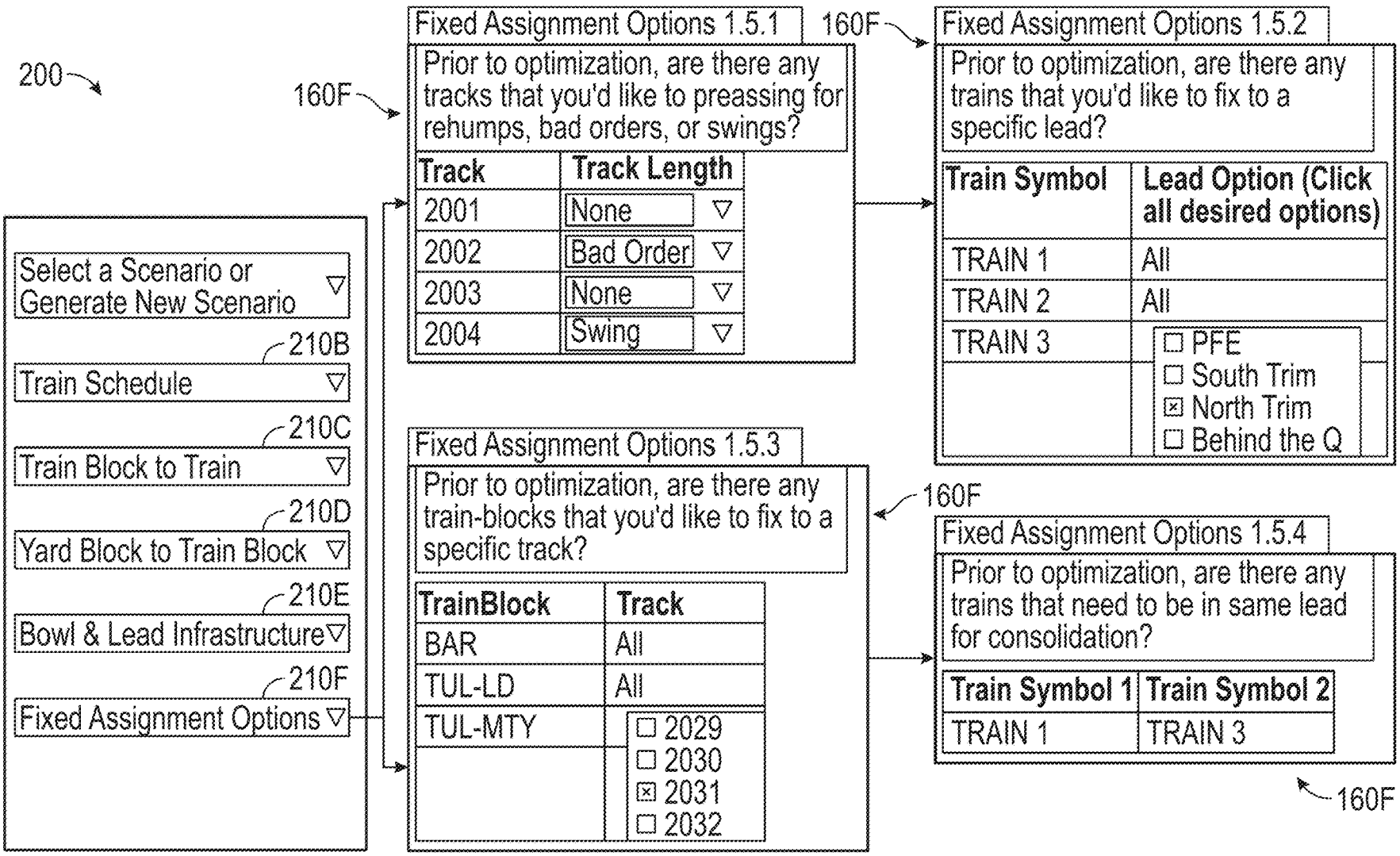

FIGS. 2-4 illustrate user interfaces 200 displaying various optimization model inputs 160 that may be used by the systems and methods presented herein, according to particular embodiments. As illustrated in FIG. 2, a user may select a user-selectable element 210B to display and edit outbound train schedules 160B. In general, outbound train schedules 160B may include one or more of: a train symbol, a frequency per week, specific days of operation in a week, a planned build time, a planned cut-off time, and a planned departure time, as illustrated. One or more of the data elements of outbound train schedules 160B may be edited by the user. In addition, a user may be provided with an interface as illustrated to enter new entries within outbound train schedules 160B.

As further illustrated in FIG. 2, a user may select a user-selectable element 210C to display and edit train block to outbound train assignments 160C. In general, train block to outbound train assignments 160C may include one or more of: a train block name/symbol, a name of an assigned outbound train, and a daily volume of the train block, as illustrated. One or more of the data elements of train block to outbound train assignments 160C may be edited by the user. In addition, a user may be provided with an interface as illustrated to enter new entries within train block to outbound train assignments 160C.

As further illustrated in FIG. 2, a user may select a user-selectable element 210D to display and edit yard block to train block assignments 160D. In general, yard block to train block assignments 160D may include a yard block name/symbol and a corresponding train block name/symbol, as illustrated. One or more of the data elements of yard block to train block assignments 160D may be edited by the user. In addition, a user may be provided with an interface as illustrated to enter new entries within yard block to train block assignments 160D.

As illustrated in FIG. 3, a user may select a user-selectable element 210E to display and edit bowl and lead assignments 160E. In general, bowl and lead assignments 160E may include one or more of: a track identifier (e.g., which classification track 123), a track length (e.g., available volume in feet of the classification track 123), and an assigned trim lead (e.g., which pull lead 124 is assigned to the classification track 123), as illustrated. One or more of the data elements of bowl and lead assignments 160E may be edited by the user. In addition, a user may be provided with an interface as illustrated to enter new entries within bowl and lead assignments 160E.

As illustrated in FIG. 4, a user may select a user-selectable element 210F to display and edit fixed assignment options 160F. In general, fixed assignment options 160F may include one or more of: a track identifier (e.g., which classification track 123) with a corresponding pre-assignment for the track, a train identifier/symbol with a corresponding lead option, a train block identifier/name with a corresponding fixed track assignment, and an option to fix two different train to the same pull lead 124, as illustrated. One or more of the data elements of fixed assignment options 160F may be edited by the user. In addition, a user may be provided with an interface as illustrated to enter new entries within fixed assignment options 160F.

Historical train block volumes 160A are daily train-block volumes (e.g., expressed in feet) for each train block 122 over a specified period at a specified percentile. As a specific example, historical train block volumes 160A may be the $80^{th}$ percentile of daily train-block volumes for each train block 122 over the preceding 35 days. In some embodiments, the specified period for historical train block volumes 160A (e.g., specific historical time windows such as the preceding 35 days) is adjustable by terminal teams to align with future operational plans. By utilizing a certain percentile (e.g., the $80^{th}$ percentile) of daily train-block volumes, train block assignment optimizer 150 provides effective block-to-track assignments that are effective not only on an "average" day but also on a heavy volume day.

As discussed above, train block assignment optimizer 150 may first apply first optimization model 151 and determine if a feasible solution can be obtained (i.e., determine if the length of the allocated classification tracks 123 to all train blocks 122 is greater than the length of the train blocks 122). If a feasible solution can be obtained, optimization model outputs 170 from first optimization model 151 are returned to the user and may be used for generating switching signals 180. On the other hand, if a feasible solution cannot be obtained using first optimization model 151 (i.e., if the length of the allocated classification tracks 123 to all train blocks 122 is less than the length of the train blocks 122), train block assignment optimizer 150 can notify a user that a feasible solution was not obtained using the first odel and utilize a second optimization model 152 to return a feasible optimal solution to the user and to generate switching signals 180. Optimization model outputs 170 from first optimization model 151 and second optimization model 152 are described in more detail below with reference to FIGS. 5-8. The Optimization model outputs 170 can be provided to a user via a GUI or other notification.

Figure 5:
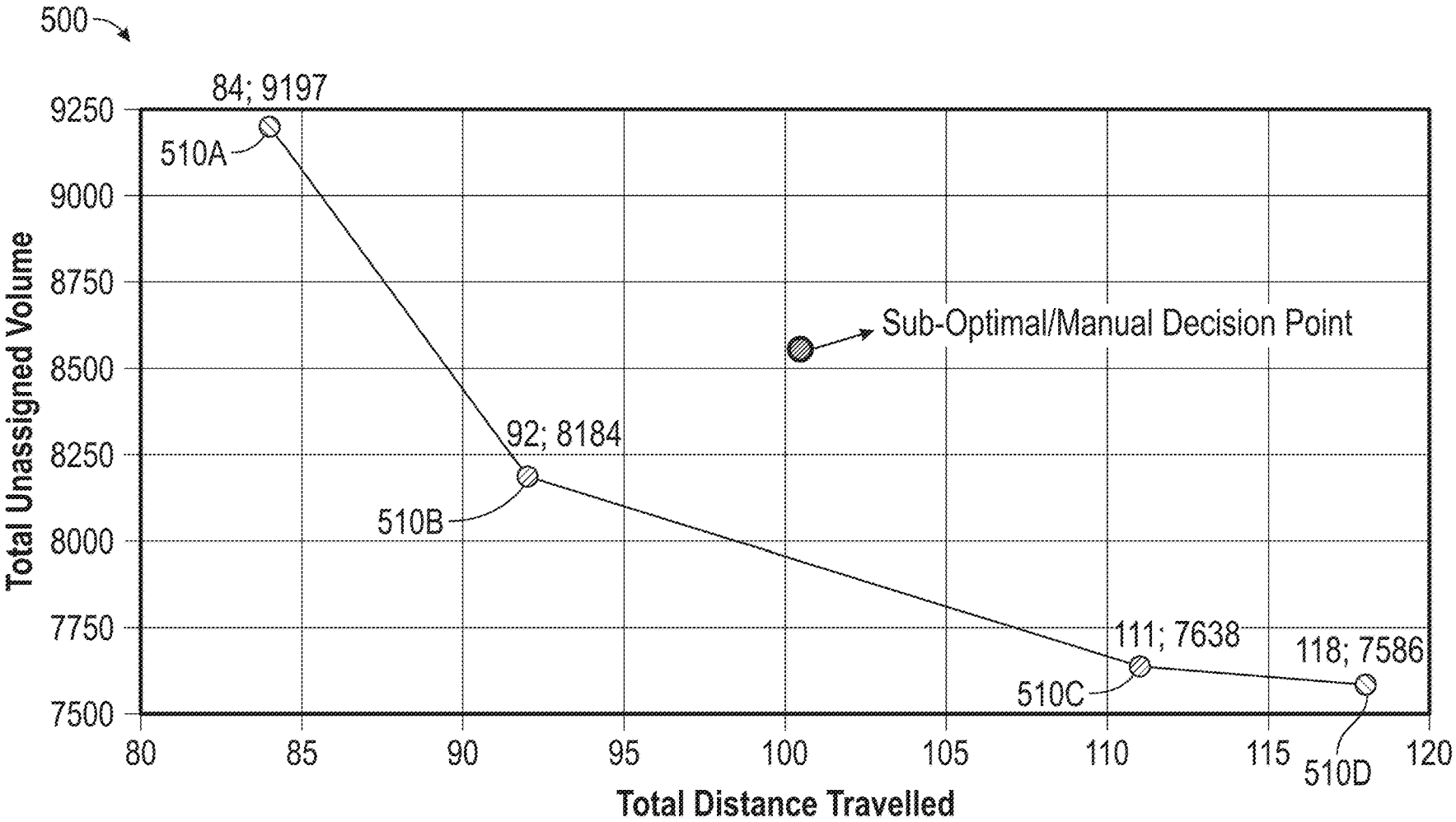
FIG. 5 illustrates an output pareto chart that may be generated by the systems and methods presented herein, according to particular embodiments.

FIG. 5 illustrates an output pareto chart 500 that may be an optimization model output 170 (i.e., pareto chart 170A) that is be generated by the systems and methods presented herein, according to particular embodiments. Pareto chart 500 may be displayed, for example, on user interface 132 of client system 130. In some embodiments, when first optimization model 151 is found to be infeasible (i.e., if the length of the allocated classification tracks 123 to all train blocks 122 is less than the length of the train blocks 122), second optimization model 152 may be used to solve for multiple (e.g., ten) different weights corresponding to the objective of distance moved by the pull engine to build the outbound trains. This output consists of multiple optimal solutions (i.e., a Pareto frontier) which is plotted as a scattered plot on pareto chart 500. The x-axis of pareto chart 500 corresponds to the "Total distance travelled" by the pull engine and the y-axis corresponds to the "Total unassigned volume" (i.e., the volume of train blocks 122 that is unable to be assigned to a classification track 123). As illustrated, pareto chart 500 includes multiple decision points 510 (e.g., 510A-510D) on a scatter plot. Each decision point 510 corresponds to a solution value obtained for these two objectives (i.e., Total unassigned volume and Total distance travelled) for multiple (e.g., ten) different weights. As a result, a user may be able to quickly view and evaluate multiple different decision point options in order to choose an option that optimally assigns train blocks 122 to classification tracks 123.

FIG. 6 illustrates a chart 600 of block-to-track assignments that may be an optimization model output 170 (i.e., block-to-track assignments 170B) that is generated by the systems and methods presented herein, according to particular embodiments. In general, chart 600 is a list of assignments of train blocks 122 to classification tracks 123 that corresponds to a particular decision point 510 (e.g., 510A-510D) on pareto chart 500. Each decision point 510 (e.g., 510A-510D) on pareto chart 500 may have a corresponding chart 600. In some embodiments, each row 620 (e.g., 620A, 620B, . . . 620*n*) of chart 600 includes a trim lead ID 601 (e.g., an identifier of which pull lead 124), a track identifier 602 (e.g., an identifier of which classification track 123), a track length 603, a train ID 604 of an assigned outbound train, and a block ID 605 (e.g., an identification of which train block 122). In some embodiments, each row 620 of chart 600 may additionally include a historical volume 606 at a certain percentile (e.g., $80^{th}$ percentile volume), an assigned volume 607 (i.e., amount in feet of the train block 122 that is assigned to the classification track 123), an unassigned volume 608 (i.e., amount in feet of the train block 122 that is unassigned to the classification track 123), a remaining footage 609 (i.e., amount in feet of the classification track 123 that is unassigned to the train block 122), and a utilization 610 that indicates a utilization percentage of the classification track 123. As a specific example, row 620A of chart 600 includes a trim lead ID 601 of 124A, a track identifier 602 of 123A, a track length 603 of 2625 feet, a train ID 604 of TRAIN 4, and a block ID 605 of 122A. Stated another way, row 620A indicates that train block 122A has been assigned by train block assignment optimizer 150 to classification track 123A that has a total available track length of 2625 feet. This assignment results in a historical $80^{th}$ percentile volume 606 of 3109 feet, an assigned volume 607 of 2625 feet, an unassigned volume 608 of 484 feet, a remaining footage 609 of 0 feet, and a utilization 610 of 100 percent.

As another specific example, row 620B of chart 600 includes a trim lead ID 601 of 124A, a track identifier 602 of 123D, a track length 603 of 2834 feet, a train ID 604 of TRAIN 5, and a block ID 605 of 122B. Stated another way, row 620B indicates that train block 122B has been assigned by train block assignment optimizer 150 to classification track 123D that has a total available track length of 2834 feet. This assignment results in a historical $80^{th}$ percentile volume 606 of 1162 feet, an assigned volume 607 of 1162 feet, an unassigned volume 608 of 0 feet, a remaining footage 609 of 1672 feet, and a utilization 610 of 41 percent.

Figure 7:
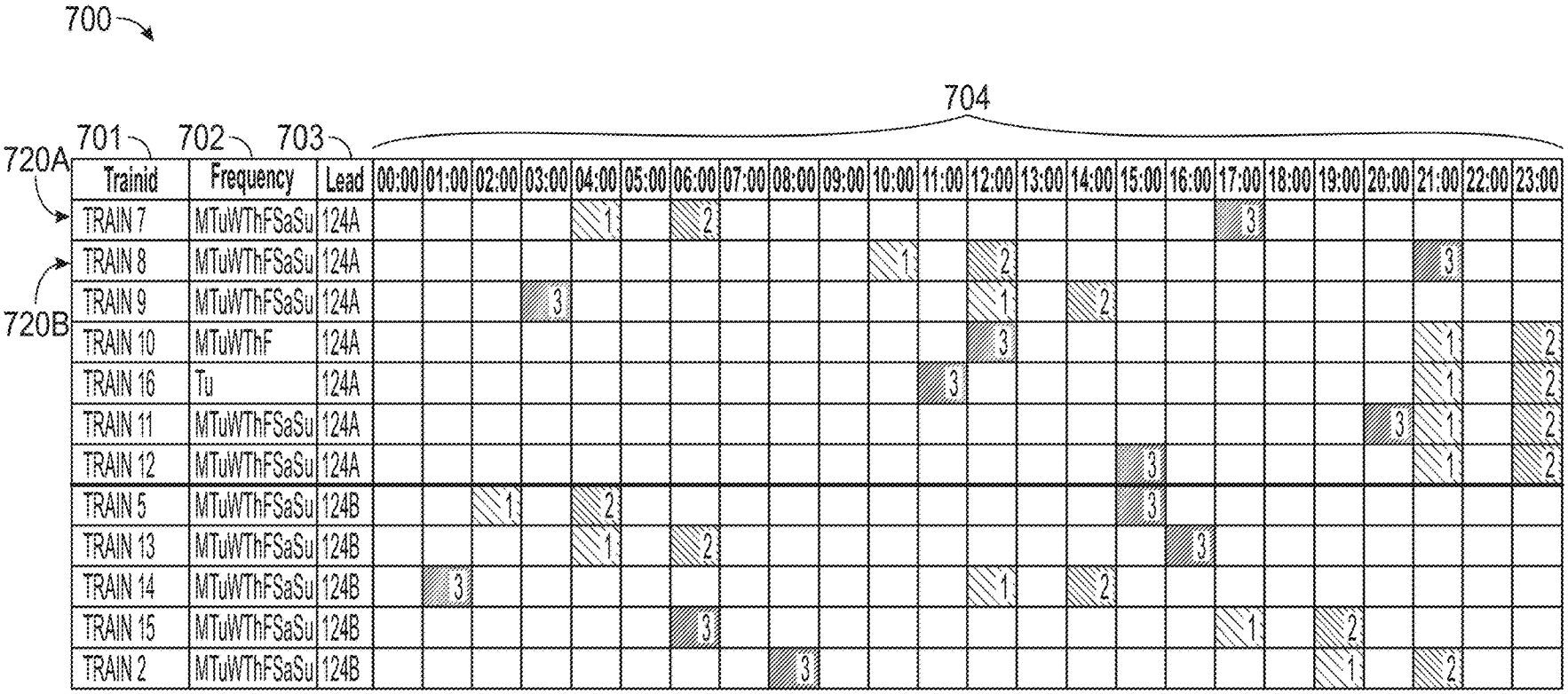
FIG. 7 illustrates pull lead assignments that may be generated by the systems and methods presented herein, according to particular embodiments.

FIG. 7 illustrates a Gantt chart 700 that may be an optimization model output 170 (i.e., pull lead assignments 170C) that is generated by the systems and methods presented herein, according to particular embodiments. In general, Gantt chart 700 provides a visual indication of pull lead assignments (i.e., assignments for pull leads 124) generated by train block assignment optimizer 150 (e.g., using first optimization model 151 or second optimization model 152). Gantt chart 700 helps visually observe conflicts with pull leads 124 with regards to build times, which may lead to suboptimal operations within classification yard 120. In some embodiments, each row 720 (e.g., 720A, 720B, . . . 720*n*) of Gantt chart 700 includes a train ID 701, a frequency 702, a pull lead assignment 703, and hours of the day 704. Train ID 701 is the identification of the outbound train to be built. Frequency 702 indicates which days of the week the train is to be built. Pull lead assignment 703 indicates which pull lead 124 will be used to build the outbound train. Hours of the day 704 indicates various actions that are to be performed during that hour of the day. In the illustrated example, a "1" in hours of the day 704 corresponds to a train cutoff time, a "2" corresponds to a train build time, and a "3" corresponds to a train departure time. Ideally, build times for various trains having the same pull lead 124 should be spread out over the hours of the day 704 (i.e., the hours having a "2" should be spread out within Gantt chart 700). For example, row 720A indicates that train "TRAIN 7" is to be built at 06:00 every day of the week using pull lead 124A, that train "TRAIN 7" has a cutoff time of 04:00, and that train "TRAIN 7" has a departure time of 17:00. As another example, row 720B indicates that train "TRAIN 8" is to be built at 12:00 every day of the week using pull lead 124A, that train "TRAIN 8" has a cutoff time of 10:00, and that train "TRAIN 8" has a departure time of 21:00. As a result, a user may be able to view Gantt chart 700 to quickly and efficiently gain a better knowledge of the pull lead assignments generated by train block assignment optimizer 150 and to quickly identify any conflicts with pull leads 124 (e.g., any situations where different trains are being built using the same pull lead 124 at the same time).

Figure 8:
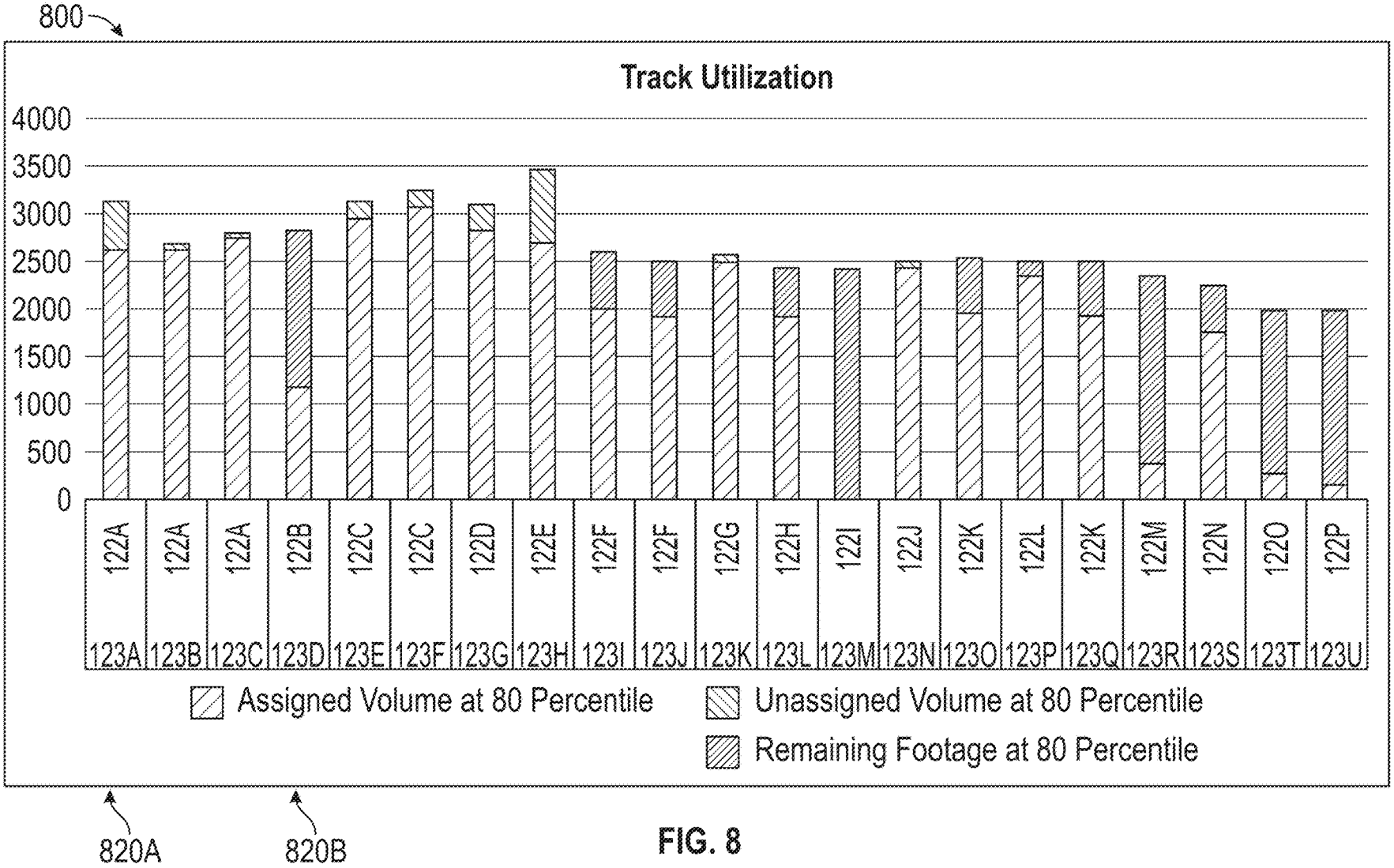
FIG. 8 illustrates a track utilization chart that may be generated by the systems and methods presented herein, according to particular embodiments.

FIG. 8 illustrates a track utilization chart 800 that may be an optimization model output 170 (i.e., track utilization 170D) that is generated by the systems and methods presented herein, according to particular embodiments. In general, track utilization chart 800 provides a visual representation of the block-to-track assignments in chart 600 of FIG. 6 and corresponds to a particular decision point 510 (e.g., 510A-510D) on pareto chart 500. Each decision point 510 (e.g., 510A-510D) on pareto chart 500 may have a corresponding chart 800.

Each data point along the x-axis of track utilization chart 800 corresponds to a row 620 of chart 600, and the y-axis indicates an amount of volume (in feet). For example, data point 820A corresponds to row 620A of chart 600 and provides a visual representation of the volume of train block 122A that is assigned to classification track 123A (e.g., a historical $80^{th}$ percentile volume of 3109 feet, an assigned volume of 2625 feet, and an unassigned volume of 484 feet). As another example, data point 820B corresponds to row 620B of chart 600 and provides a visual representation of the volume of train block 122B that is assigned to classification track 123D (e.g., a historical $80^{th}$ percentile volume of 1162 feet, an assigned volume of 1162 feet, an unassigned volume of 0 feet, and a remaining footage of 1672 feet).

Switching signals 180 are any electronic signals that are sent (e.g., wirelessly or wired) to hump yard switching equipment 125 in order to automatically control switching operations of railcars 121 and to direct railcars 121 to their assigned classification tracks 123 according to the outputs 170 of train block assignment optimizer 150. For example, if a list of train block assignments (e.g., chart 600) for train blocks 122 and classification tracks 123 is generated by train block assignment optimizer 150 (i.e., using first optimization model 151 or second optimization model 152), the assignments may be communicated to hump yard switching equipment 125 using switching signals 180. As a specific example, when train block 122A is separated from an inbound train, it may be automatically directed to its assigned track (e.g., classification track 123A as shown in row 620A of chart 600) using switching signals 180. To do so, computing system 110 may send switching signals 180 to hump yard switching equipment 125 that operate one or more track switches in order to direct train block 122A to classification track 123A in classification yard 120.

In operation, and in reference to FIGS. 1-8, train block assignment optimization system 100 utilizes train block assignment optimizer 150 to provide optimization model outputs 170 (i.e., pareto chart 170A, block-to-track assignments 170B, pull lead assignments 170C, and track utilization 170D) for assigning train blocks 122 (e.g., 122A and 122B) to classification tracks 123 (e.g., 123A-123F) of classification yard 120. To do so, some embodiments of train block assignment optimizer 150 first access one or more optimization model inputs 160. For example, train block assignment optimizer 150 may access historical train block volumes 160A, outbound train schedules 160B, train block to outbound train assignments 160C, yard block to train block assignments 160D, bowl and lead assignments 160E, and fixed assignment options 160F. Optimization model inputs 160 may be stored in memory 115 of computing system 110. In some embodiments, one or more of optimization model inputs 160 may be received from a remote computer system (e.g., via network 140).

In some embodiments, train block assignment optimization system 100 may display one or more of optimization model inputs 160 on client system 130 in order to allow a user to verify, edit, or add information to optimization model inputs 160. For example, computing system 110 may send optimization model inputs 160 for display on client system 130 via network 140. If a user edits or adds information to optimization model inputs 160, the modified optimization model inputs 160 may then be sent back to computing system 110 from client system 130 for storage in memory 115.

Next, train block assignment optimization system 100 utilizes optimization model inputs 160 and two different optimization models: a first optimization model 151 and a second optimization model 152. In some embodiments, train block assignment optimizer 150 may first utilize first optimization model 151 to determine a first list of train block assignments (e.g., chart 600) for train blocks 122 and classification tracks 123 of classification yard 120 (e.g., a classification bowl), as described using the detailed equations and formulas above. If the solution is feasible (e.g., if a volume of the train blocks 122 is less than a total available track length of classification tracks 123), the optimization model outputs 170 of first optimization model 151 may be utilized. For example, the optimization model outputs 170 from first optimization model 151 may be sent for display on client system 130. In addition, the optimization model outputs 170 from first optimization model 151 may be used to generate switching signals 180 which are then sent to hump yard switching equipment 125. However, if the solution of first optimization model 151 is determined to not be feasible (e.g., if a volume of the train blocks 122 is greater than a total available track length of classification tracks 123), train block assignment optimizer 150 may generate optimization model outputs 170 using second optimization model 152, as described using the detailed equations and formulas above. Second optimization model 152 may have relaxed constraints from first optimization model 151, as discussed above. The optimization model outputs 170 from second optimization model 152 may be sent for display on client system 130 and/or be used to generate switching signals 180 that are then sent to hump yard switching equipment 125. As a result, assignments of train blocks 122 to classification tracks 123 within classification yard 120 may be optimized and be more efficient than typical operations where a Trainmaster manually decides train block 122 assignments within classification yard 120. Specific methods utilizing train block assignment optimizer 150 to generate optimization model outputs 170 are discussed in more detail below with respect to FIG. 9-11.

Figure 9:
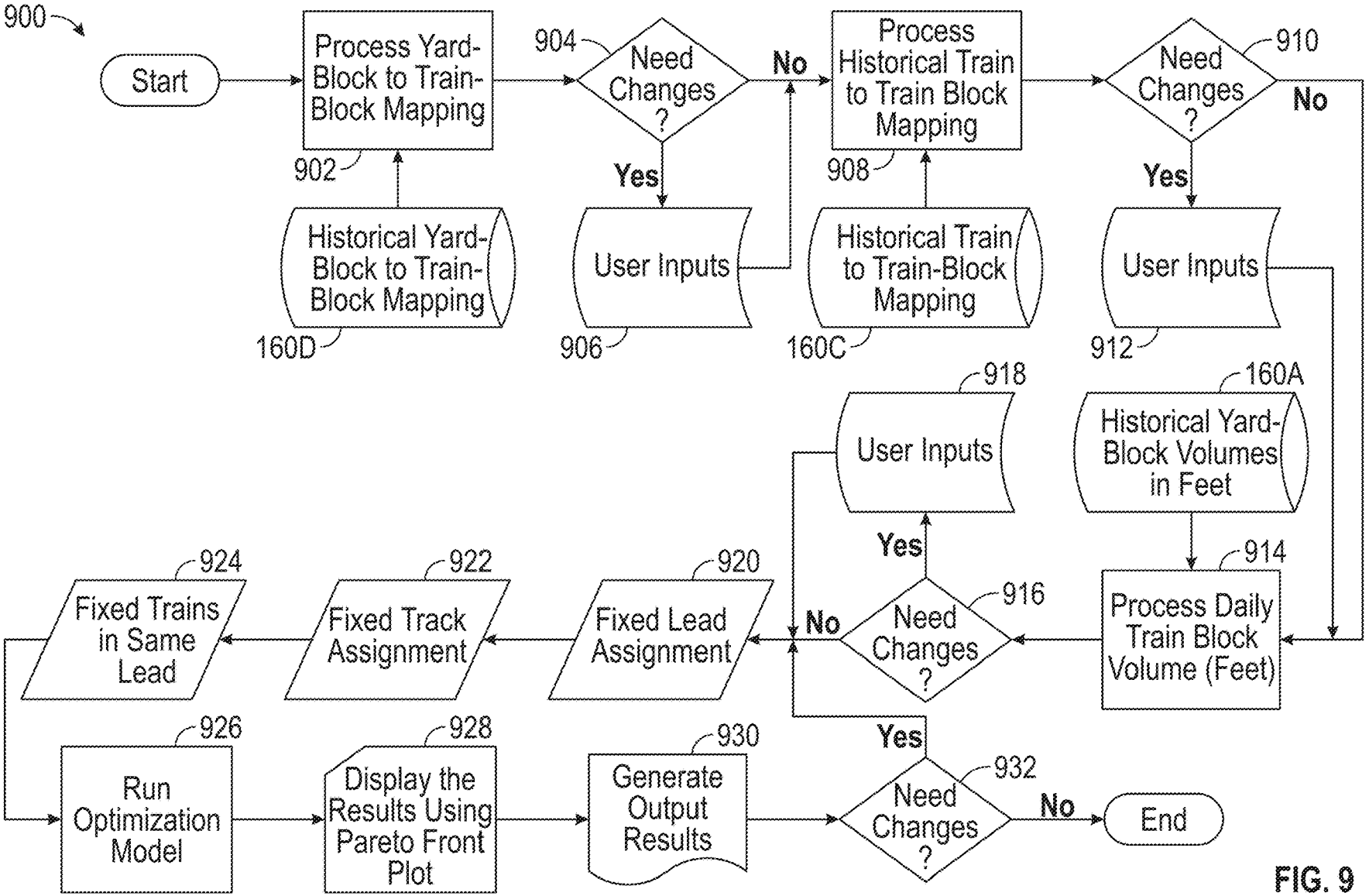
FIG. 9 is a chart illustrating a method for optimally assigning train blocks at a railroad merchandise yard, according to particular embodiments.

FIG. 9 is a chart illustrating a method 900 for optimally assigning train blocks such as train blocks 122 at a railroad merchandise yard 120, according to particular embodiments. In some embodiments, method 900 may be performed by train block assignment optimizer 150 of train block assignment optimization system 100. At step 902, method 900 processes yard block to train block assignments 160D. In some embodiments, yard block to train block assignments 160D are stored in memory 115 of computing system 110. In some embodiments, yard block to train block assignments 160D are electronically retrieved from a remote computing system. An example of yard block to train block assignments 160D is illustrated in FIG. 2.

At step 904, method 900 determines if any changes are needed in yard block to train block assignments 160D. To do so, yard block to train block assignments 160D may be sent to and displayed on client system 130. If a user makes any changes to yard block to train block assignments 160D using client system 130, the changes are received by computing system 110 and processed by method 900 at step 906. If no changes are made to yard block to train block assignments 160D, method 900 proceeds to step 908.

At step 908, method 900 processes historical train block to outbound train assignments 160C. In some embodiments, train block to outbound train assignments 160° C. are stored in memory 115 of computing system 110. In some embodiments, train block to outbound train assignments 160C are electronically retrieved from a remote computing system. An example of train block to outbound train assignments 160C is illustrated in FIG. 2.

At step 910, method 900 determines if any changes are needed in train block to outbound train assignments 160C. To do so, train block to outbound train assignments 160C may be sent to and displayed on client system 130. If a user makes any changes to train block to outbound train assignments 160C using client system 130, the changes are received by computing system 110 and processed by method 900 at step 912. If no changes are made to train block to outbound train assignments 160C, method 900 proceeds to step 914.

At step 914, method 900 processes historical train block volumes 160A. In some embodiments, historical train block volumes 160A are stored in memory 115 of computing system 110. In some embodiments, historical train block volumes 160A are electronically retrieved from a remote computing system.

At step 916, method 900 determines if any changes are needed in historical train block volumes 160A. To do so, historical train block volumes 160A may be sent to and displayed on client system 130. If a user makes any changes to historical train block volumes 160A using client system 130, the changes are received by computing system 110 and processed by method 900 at step 918. If no changes are made to historical train block volumes 160A, method 900 proceeds to step 920.

At step 920, method 900 access fixed lead assignments within fixed assignment options 160F. At step 922, method 900 access fixed track assignments within fixed assignment options 160F. At step 924, method 900 access fixed assignment options 160F to retrieve assignments for fixed trains within the same lead. An example of fixed assignment options 160F is illustrated in FIG. 4.

At step 926, method 900 utilizes the various optimization model inputs 160 from steps 902, 908, 914, 920, 922, and 924 to execute train block assignment optimizer 150. Step 926 may include utilizing first optimization model 151 or second optimization model 152, as described above. A specific example of a method that may be performed in step 926 is described in more detail with regard to FIG. 10.

At step 928, some embodiments of method 900 may display the results of step 926 using a Pareto front plot. An example Pareto front plot is illustrated and described in reference to FIG. 5. In some embodiments, a user may select a particular decision point 510 from the Pareto front plot.

At step 930, method 900 generates optimization model outputs 170. In some embodiments, the generated optimization model outputs 170 are based on the user-selection of a particular decision point 510 from the Pareto front plot of step 928. For example, if a user selects decision point 510A that corresponds to a total distance travelled by a pull engine of 84 and a total unassigned volume of 9197 feet, method 900 may generate the train block to track assignments that correspond to decision point 510A. Method 900 may then output the corresponding optimization model outputs 170 (e.g., block-to-track assignments 170B, pull lead assignments 170C, and track utilization 170D). After step 930, method 900 may proceed to step 932 where a user is given an opportunity to make changes to optimization model outputs 170. After step 932, method 900 may end.

Particular embodiments may repeat one or more steps of the method of FIG. 9, where appropriate. Although this disclosure describes and illustrates particular steps of the method of FIG. 9 as occurring in a particular order, this disclosure contemplates any suitable steps of the method of FIG. 9 occurring in any suitable order. Moreover, although this disclosure describes and illustrates an example method for optimally assigning train blocks at a classification yard including the particular steps of the method of FIG. 9, this disclosure contemplates any suitable method for optimally assigning train blocks at a classification yard including any suitable steps, which may include all, some, or none of the steps of the method of FIG. 9, where appropriate. Furthermore, although this disclosure describes and illustrates particular components, devices, or systems carrying out particular steps of the method of FIG. 9, this disclosure contemplates any suitable combination of any suitable components, devices, or systems carrying out any suitable steps of the method of FIG. 9.

Figure 10:
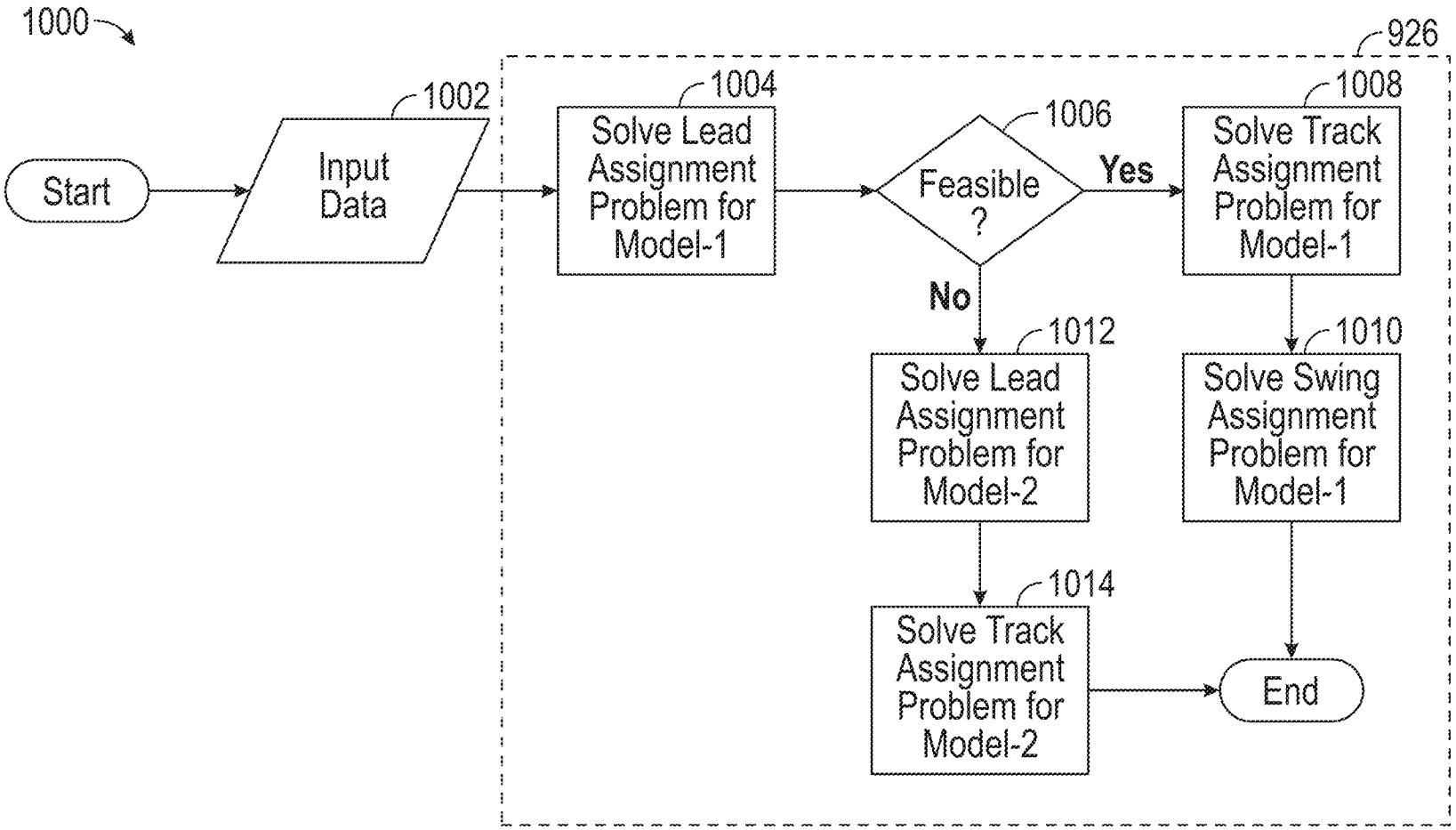
FIG. 10 is a chart illustrating additional details of the method for optimally assigning train blocks at a railroad merchandise yard of FIG. 9, according to particular embodiments.

FIG. 10 is a chart illustrating a method 1000 that may be used for step 926 of method 900 in FIG. 9, according to particular embodiments. At step 1002, method 1000 accesses input data. In some embodiments, the input data includes one or more optimization model inputs 160 as described herein. At step 1004, method 1000 utilizes first optimization model 151 to solve the assignment problem for pull leads 124. In some embodiments, step 1004 solves the assignment problem for pull leads 124 using the detailed equations and formulas describe above.

After step 1004, method 1000 proceeds to step 1006 where method 1000 determines whether the solution of step 1004 is feasible. In some embodiments, step 1004 includes determining if a volume of train blocks 122 is less than a total available track length of classification tracks 123. If the volume of train blocks 122 is determined to be less than a total available track length of classification tracks 123 in step 1006, the solution is found to be feasible and method 1000 proceeds to step 1008. If the volume of train blocks 122 is determined to be greater than a total available track length of classification tracks 123 in step 1006, the solution is found to not be feasible and method 1000 proceeds to step 1012.

At step 1008, method 1000 solves the track assignment problem as described herein using first optimization model 151 and then proceeds to step 1010. At step 1010, method 1000 solves the swing track assignment problem as described herein using first optimization model 151. After step 1010, method 1000 may end.

At step 1012, method 1000 solves the lead assignment problem using second optimization model 152 as described herein and then proceeds to step 1014. At step 1014, method 1000 solves the track assignment problem as described herein using second optimization model 152. After step 1014, method 1000 may end.

Particular embodiments may repeat one or more steps of the method of FIG. 10, where appropriate. Although this disclosure describes and illustrates particular steps of the method of FIG. 10 as occurring in a particular order, this disclosure contemplates any suitable steps of the method of FIG. 10 occurring in any suitable order. Moreover, although this disclosure describes and illustrates an example method including the particular steps of the method of FIG. 10, this disclosure contemplates any suitable method including any suitable steps, which may include all, some, or none of the steps of the method of FIG. 10, where appropriate. Furthermore, although this disclosure describes and illustrates particular components, devices, or systems carrying out particular steps of the method of FIG. 10, this disclosure contemplates any suitable combination of any suitable components, devices, or systems carrying out any suitable steps of the method of FIG. 10.

Figure 11:
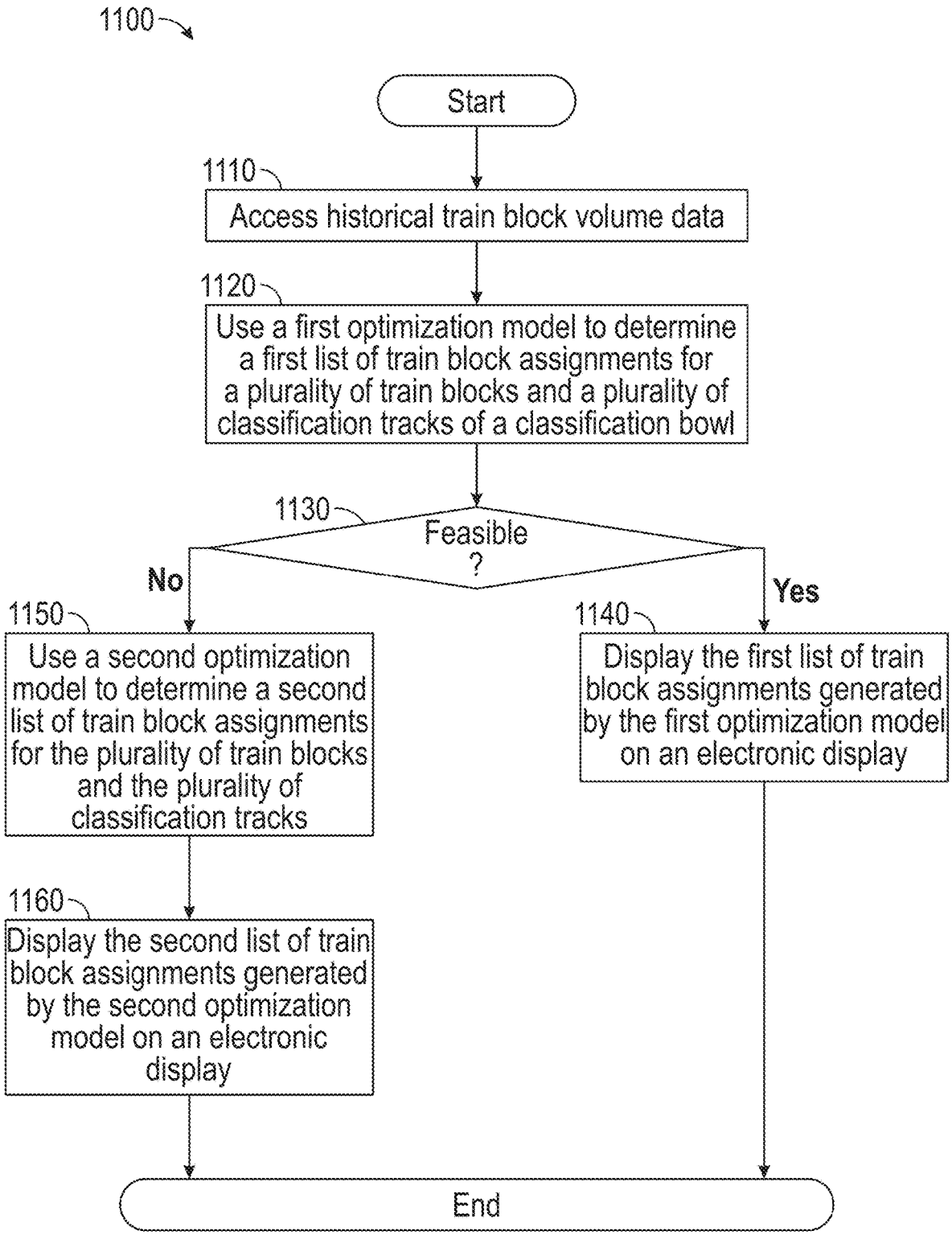
FIG. 11 is a chart illustrating another method for optimally assigning train blocks at a railroad merchandise yard, according to particular embodiments.

FIG. 11 is a chart illustrating another method 1100 for optimally assigning train blocks at a railroad merchandise yard, according to particular embodiments. In some embodiments, method 1100 may be performed by train block assignment optimizer 150 of train block assignment optimization system 100. At step 1110, method 1100 accesses historical train block volume data. In some embodiments, the historical train block volume data is historical train block volumes 160A that is stored in memory 115 of computing system 110. In some embodiments, the historical train block volume data includes a predetermined percentile (e.g., the $80^{th}$ percentile) of daily train block volumes over a predetermined number of preceding days (e.g., 35 days).

At step 1120, method 1100 determines, using a first optimization model and the historical train block volume data of step 1110, a first list of train block assignments for a plurality of train blocks and a plurality of classification tracks of a classification bowl. In some embodiments, the first optimization model is first optimization model 151, the plurality of train blocks are train blocks 122, the plurality of classification tracks are classification tracks 123, and the classification bowl is classification yard 120. In some embodiments, the first list of train block assignments is chart 600 generated by first optimization model 151. In some embodiments, the first optimization model: minimizes an amount of total distance a plurality of pull engines must travel to build a plurality of outbound trains; minimizes a total number of conflicting pull leads; minimizes a total number of outbound trains present in multiple pull-leads; minimizes a number of swing tracks assigned in between train blocks belonging to a same outbound train; and maximizes a total number of assigned swing tracks.

At step 1130, method 1100 determines whether using first optimization model 151 in step 1120 provided a feasible solution. In some embodiments, step 1130 includes determining whether a volume of the plurality of train blocks is greater than a total available track length of the plurality of classification tracks. In some embodiments, the volume of the plurality of train blocks is a total length of all railcars 121 of the train block in feet. In some embodiments, step 1130 includes determining whether a volume of the plurality of train blocks is greater than a total available track length of the plurality of classification tracks such that the business and/or operational constraints are satisfied using an optimization model. If method 1100 determines in step 1130 that the solution provided by the first optimization model in step 1120 is feasible, method 1100 proceeds to step 1140. Otherwise, if method 1100 determines in step 1130 that the solution provided by the first optimization model in step 1120 is not feasible, method 1100 proceeds to step 1150.

At step 1140, method 1100 displays the first list of train block assignments generated by the first optimization model on an electronic display. In some embodiments, the electronic display is an electronic display of client system 130. After step 1140, method 1100 may end.

At step 1150, method 1100 determines, using a second optimization model and the historical train block volume data, a second list of train block assignments for the plurality of train blocks and the plurality of classification tracks. In some embodiments, the second optimization model is second optimization model 152. In some embodiments, the second list of train block assignments is chart 600 generated by second optimization model 152. In some embodiments, the second optimization model: minimizes an amount of total distance a plurality of pull engines must travel to build a plurality of outbound trains; minimizes a total number of conflicting pull leads; minimizes a total number of outbound trains present in multiple pull-leads; and minimizes a volume of unassigned train blocks.

At step 1160, method 1100 displays the second list of train block assignments generated by the second optimization model on an electronic display. In some embodiments, the electronic display is an electronic display of client system 130. After step 1160, method 1100 may end.

In some embodiments, method 1100 may additionally display, on the electronic display, a pareto chart that illustrates various optimization solutions/options according to either the first optimization model or the second optimization model. Each optimization solution/option may include a total unassigned volume and a corresponding total distance travelled by a pull engine. In some embodiments, the pareto chart is pareto chart 500. In some embodiments, each optimization solution/option is a decision point 510 of FIG. 5.

In some embodiments, method 1100 may additionally display, on the electronic display, a pull lead assignment chart that visually indicates a plurality of build times for the plurality of train blocks, at least some of the plurality of classification tracks of the classification bowl, and one or more pull leads. In some embodiments, the pull lead assignment chart is Gantt chart 700 of FIG. 7.

In some embodiments, method 1100 may additionally display, on the electronic display, a track utilization graphic that visually indicates, for each of at least some of the plurality of classification tracks of the classification bowl, an assigned train block volume, an unassigned train block volume, and an amount of remaining track footage. In some embodiments, the track utilization graphic is track utilization chart 800 of FIG. 8.

Particular embodiments may repeat one or more steps of the method of FIG. 11, where appropriate. Although this disclosure describes and illustrates particular steps of the method of FIG. 11 as occurring in a particular order, this disclosure contemplates any suitable steps of the method of FIG. 11 occurring in any suitable order. Moreover, although this disclosure describes and illustrates an example method including the particular steps of the method of FIG. 11, this disclosure contemplates any suitable method including any suitable steps, which may include all, some, or none of the steps of the method of FIG. 11, where appropriate. Furthermore, although this disclosure describes and illustrates particular components, devices, or systems carrying out particular steps of the method of FIG. 11, this disclosure contemplates any suitable combination of any suitable components, devices, or systems carrying out any suitable steps of the method of FIG. 11.

Figure 12:
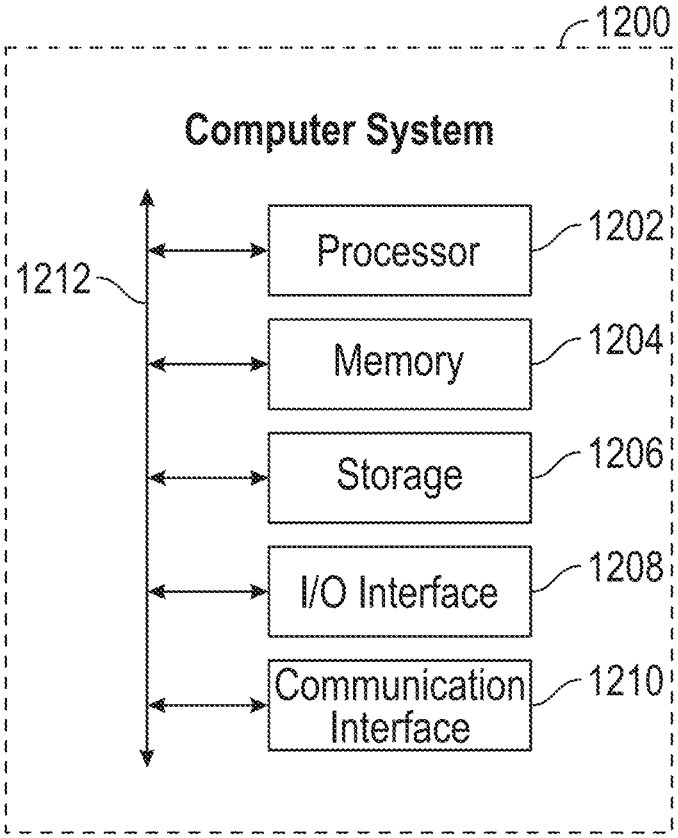
FIG. 12 is an example computer system that can be utilized to implement aspects of the various technologies presented herein, according to particular embodiments.

FIG. 12 illustrates an example computer system 1200 that can be utilized to implement aspects of the various methods and systems presented herein, according to particular embodiments. In particular embodiments, one or more computer systems 1200 perform one or more steps of one or more methods described or illustrated herein. In particular embodiments, one or more computer systems 1200 provide functionality described or illustrated herein. In particular embodiments, software running on one or more computer systems 1200 performs one or more steps of one or more methods described or illustrated herein or provides functionality described or illustrated herein. Particular embodiments include one or more portions of one or more computer systems 1200. Herein, reference to a computer system may encompass a computing device, and vice versa, where appropriate. Moreover, reference to a computer system may encompass one or more computer systems, where appropriate.

This disclosure contemplates any suitable number of computer systems 1200. This disclosure contemplates computer system 1200 taking any suitable physical form. As example and not by way of limitation, computer system 1200 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, an augmented/virtual reality device, or a combination of two or more of these. Where appropriate, computer system 1200 may include one or more computer systems 1200; be unitary or distributed; span multiple locations; span multiple machines; span multiple data centers; or reside in a cloud, which may include one or more cloud components in one or more networks. Where appropriate, one or more computer systems 1200 may perform without substantial spatial or temporal limitation one or more steps of one or more methods described or illustrated herein. As an example, and not by way of limitation, one or more computer systems 1200 may perform in real time or in batch mode one or more steps of one or more methods described or illustrated herein. One or more computer systems 1200 may perform at different times or at different locations one or more steps of one or more methods described or illustrated herein, where appropriate.

In particular embodiments, computer system 1200 includes a processor 1202, memory 1204, storage 1206, an input/output (I/O) interface 1208, a communication interface 1210, and a bus 1212. Although this disclosure describes and illustrates a particular computer system having a particular number of particular components in a particular arrangement, this disclosure contemplates any suitable computer system having any suitable number of any suitable components in any suitable arrangement.

In particular embodiments, processor 1202 includes hardware for executing instructions, such as those making up a computer program. As an example, and not by way of limitation, to execute instructions, processor 1202 may retrieve (or fetch) the instructions from an internal register, an internal cache, memory 1204, or storage 1206; decode and execute them; and then write one or more results to an internal register, an internal cache, memory 1204, or storage 1206. In particular embodiments, processor 1202 may include one or more internal caches for data, instructions, or addresses. This disclosure contemplates processor 1202 including any suitable number of any suitable internal caches, where appropriate. As an example, and not by way of limitation, processor 1202 may include one or more instruction caches, one or more data caches, and one or more translation lookaside buffers (TLBs). Instructions in the instruction caches may be copies of instructions in memory 1204 or storage 1206, and the instruction caches may speed up retrieval of those instructions by processor 1202. Data in the data caches may be copies of data in memory 1204 or storage 1206 for instructions executing at processor 1202 to operate on; the results of previous instructions executed at processor 1202 for access by subsequent instructions executing at processor 1202 or for writing to memory 1204 or storage 1206; or other suitable data. The data caches may speed up read or write operations by processor 1202. The TLBs may speed up virtual-address translation for processor 1202. In particular embodiments, processor 1202 may include one or more internal registers for data, instructions, or addresses. This disclosure contemplates processor 1202 including any suitable number of any suitable internal registers, where appropriate. Where appropriate, processor 1202 may include one or more arithmetic logic units (ALUs); be a multi-core processor; or include one or more processors 1202. Although this disclosure describes and illustrates a particular processor, this disclosure contemplates any suitable processor.

In particular embodiments, memory 1204 includes main memory for storing instructions for processor 1202 to execute or data for processor 1202 to operate on. As an example, and not by way of limitation, computer system 1200 may load instructions from storage 1206 or another source (such as, for example, another computer system 1200) to memory 1204. Processor 1202 may then load the instructions from memory 1204 to an internal register or internal cache. To execute the instructions, processor 1202 may retrieve the instructions from the internal register or internal cache and decode them. During or after execution of the instructions, processor 1202 may write one or more results (which may be intermediate or final results) to the internal register or internal cache. Processor 1202 may then write one or more of those results to memory 1204. In particular embodiments, processor 1202 executes only instructions in one or more internal registers or internal caches or in memory 1204 (as opposed to storage 1206 or elsewhere) and operates only on data in one or more internal registers or internal caches or in memory 1204 (as opposed to storage 1206 or elsewhere). One or more memory buses (which may each include an address bus and a data bus) may couple processor 1202 to memory 1204. Bus 1212 may include one or more memory buses, as described below. In particular embodiments, one or more memory management units (MMUs) reside between processor 1202 and memory 1204 and facilitate accesses to memory 1204 requested by processor 1202. In particular embodiments, memory 1204 includes random access memory (RAM). This RAM may be volatile memory, where appropriate. Where appropriate, this RAM may be dynamic RAM (DRAM) or static RAM (SRAM). Moreover, where appropriate, this RAM may be single-ported or multi-ported RAM. This disclosure contemplates any suitable RAM. Memory 1204 may include one or more memories 1204, where appropriate. Although this disclosure describes and illustrates particular memory, this disclosure contemplates any suitable memory.

In particular embodiments, storage 1206 includes mass storage for data or instructions. As an example, and not by way of limitation, storage 1206 may include a hard disk drive (HDD), a floppy disk drive, flash memory, an optical disc, a magneto-optical disc, magnetic tape, or a Universal Serial Bus (USB) drive or a combination of two or more of these. Storage 1206 may include removable or non-removable (or fixed) media, where appropriate. Storage 1206 may be internal or external to computer system 1200, where appropriate. In particular embodiments, storage 1206 is non-volatile, solid-state memory. In particular embodiments, storage 1206 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 1206 taking any suitable physical form. Storage 1206 may include one or more storage control units facilitating communication between processor 1202 and storage 1206, where appropriate. Where appropriate, storage 1206 may include one or more storages 1206. Although this disclosure describes and illustrates particular storage, this disclosure contemplates any suitable storage.

In particular embodiments, I/O interface 1208 includes hardware, software, or both, providing one or more interfaces for communication between computer system 1200 and one or more I/O devices. Computer system 1200 may include one or more of these I/O devices, where appropriate. One or more of these I/O devices may enable communication between a person and computer system 1200. As an example, and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 1208 for them. Where appropriate, I/O interface 1208 may include one or more device or software drivers enabling processor 1202 to drive one or more of these I/O devices. I/O interface 1208 may include one or more I/O interfaces 1208, where appropriate. Although this disclosure describes and illustrates a particular I/O interface, this disclosure contemplates any suitable I/O interface.

In particular embodiments, communication interface 1210 includes hardware, software, or both providing one or more interfaces for communication (such as, for example, packet-based communication) between computer system 1200 and one or more other computer systems 1200 or one or more networks. As an example, and not by way of limitation, communication interface 1210 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 1210 for it. As an example, and not by way of limitation, computer system 1200 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 1200 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network, a Long-Term Evolution (LTE) network, or a 5G network), or other suitable wireless network or a combination of two or more of these. Computer system 1200 may include any suitable communication interface 1210 for any of these networks, where appropriate. Communication interface 1210 may include one or more communication interfaces 1210, where appropriate. Although this disclosure describes and illustrates a particular communication interface, this disclosure contemplates any suitable communication interface.

In particular embodiments, bus 1212 includes hardware, software, or both coupling components of computer system 1200 to each other. As an example and not by way of limitation, bus 1212 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 1212 may include one or more buses 1212, where appropriate. Although this disclosure describes and illustrates a particular bus, this disclosure contemplates any suitable bus or interconnect.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

Moreover, the description in this patent document should not be read as implying that any particular element, step, or function can be an essential or critical element that must be included in the claim scope. Also, none of the claims can be intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "member," "module," "device," "unit," "component," "element," "mechanism," "apparatus," "machine," "system," "processor," "processing device," or "controller" within a claim can be understood and intended to refer to structures known to those skilled in the relevant art, as further modified or enhanced by the features of the claims themselves, and can be not intended to invoke 35 U.S.C. § 112(f). Even under the broadest reasonable interpretation, in light of this paragraph of this specification, the claims are not intended to invoke 35 U.S.C. § 112(f) absent the specific language described above.

The disclosure may be embodied in other specific forms without departing from the spirit or essential characteristics thereof. For example, each of the new structures described herein, may be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the disclosures can be established by the appended claims rather than by the foregoing description. All changes which come within the meaning and range of equivalency of the claims are therefore intended to be embraced therein. Further, the individual elements of the claims are not well-understood, routine, or conventional. Instead, the claims are directed to the unconventional inventive concept described in the specification.

The invention claimed is:

1. A system for assigning train blocks at a classification yard, comprising:

one or more memory units configured to store historical train block volume data; and one or more computer processors communicatively coupled to the one or more memory units and configured to execute computer program instructions, wherein the configuration of the one or more computer processors to execute the computer program instructions includes configuration to spawn a first computer process configured to execute a first set of computer program instructions from the computer program instructions to perform a first set of program steps for assigning train blocks and to spawn a second computer process configured to execute a second set of computer program instructions from the computer program instructions to perform a second set of program steps for the ng train blocks, wherein the first computer process and the second computer process are spawned concurrently, wherein the one or more computer processors is configured to execute the first set of program steps and the second set of program steps to:

access the historical train block volume data;

determine, using a first optimization model and the historical train block volume data, a first list of train block assignments for a plurality of train blocks and a plurality of classification tracks of a classification bowl;

determine whether a volume of the plurality of train blocks is greater than a total available track length of the plurality of classification tracks;

in response to determining that the volume of the plurality of train blocks is not greater than the total available track length of the plurality of classification tracks, display the first list of train block assignments generated by the first optimization model on an electronic display; and in response to determining that the volume of the plurality of train blocks is greater than the total available track length of the plurality of classification tracks:

determine, using a second optimization model and the historical train block volume data, a second list of train block assignments for the plurality of train blocks and the plurality of classification tracks; and display the second list of train block assignments generated by the second optimization model on the electronic display.

2. The system of claim 1, wherein the first optimization model;

minimizes an amount of total distance a plurality of pull engines must travel to build a plurality of outbound trains;

minimizes a total number of conflicting pull leads;

minimizes a total number of outbound trains present in multiple pull-leads; and minimizes a number of swing tracks assigned in between train blocks belonging to a same outbound train.

3. The system of claim 1, wherein the second optimization model;

minimizes an amount of total distance a plurality of pull engines must travel to build plurality of outbound trains;

minimizes a total number of conflicting pull leads;

minimizes a total number of outbound trains present in multiple pull-leads; and minimizes a volume of unassigned train blocks.

4. The system of claim 1, wherein the historical train block volume data comprises a predetermined percentile of daily train block volumes over a predetermined number of preceding days.

5. The system of claim 1, wherein the first list of train block assignments and the second list of train block assignments each indicate an assigned classification track of the plurality of classification tracks for each train block of the plurality of train blocks.

6. The system of claim 1, the one or more computer processors further configured to display, on the electronic display, a pareto chart that illustrates various optimization solutions according to either the first optimization model or the second optimization model, each optimization solution comprising a total unassigned volume and a corresponding total distance travelled by a pull engine.

7. The system of claim 1, the one or more computer processors further configured to display, on the electronic display:

a pull lead assignment chart that visually indicates a plurality of build times for the plurality of train blocks, at least some of the plurality of classification tracks of the classification bowl, and one or more pull leads; and a track utilization graphic that visually indicates, for each of at least some of the plurality of classification tracks of the classification bowl, an assigned train block volume, an unassigned train block volume, and an amount of remaining track footage.

8. A method by a computing system for assigning train blocks at a railroad merchandise yard, the computing system including one or more processors configured to execute computer program instructions, the method comprising:

spawning a first computer process configured to execute a first set of computer program instructions of the computer program instructions to perform a first set of steps of the method for assigning train blocks at the railroad merchandise yard;

spawning, concurrently with the spawning of the first computer process, a second computer process configured to execute a second set of computer program instructions of the computer program instructions to perform a second set of steps of the method for assigning train blocks at the railroad merchandise yard;

accessing historical train block volume data;

determining, using a first optimization model and the historical train block volume data, a first list of train block assignments for a plurality of train blocks and a plurality of classification tracks of a classification bowl;

determining whether a volume of the plurality of train blocks is greater than a total available track length of the plurality of classification tracks;

in response to determining that the volume of the plurality of train blocks is not greater than the total available track length of the plurality of classification tracks, displaying the first list of train block assignments generated by the first optimization model on an electronic display; and in response to determining that the volume of the plurality of train blocks is greater than the total available track length of the plurality of classification tracks:

determining, using a second optimization model and the historical train block volume data, a second list of train block assignments for the plurality of train blocks and the plurality of classification tracks; and displaying the second list of train block assignments generated by the second optimization model on the electronic display.

9. The method of claim 8, wherein the first optimization model:

minimizes an amount of total distance a plurality of pull engines must travel to build a plurality of outbound trains;

minimizes a total number of conflicting pull leads;

minimizes a total number of outbound trains present in multiple pull-leads; and minimizes a number of swing tracks assigned in between train blocks belonging to a same outbound train.

10. The method of claim 8, wherein the second optimization model:

minimizes an amount of total distance a plurality of pull engines must travel to build a plurality of outbound trains;

minimizes a total number of conflicting pull leads;

minimizes a total number of outbound trains present in multiple pull-leads; and minimizes a volume of unassigned train blocks.

11. The method of claim 8, wherein the historical train block volume data comprises a predetermined percentile of daily train block volumes over a predetermined number of preceding days.

12. The method of claim 8, wherein the first list of train block assignments and the second list of train block assignments each indicate an assigned classification track of the plurality of classification tracks for each train block of the plurality of train blocks.

13. The method of claim 8, further comprising displaying, on the electronic display, a pareto chart that illustrates various optimization solutions according to either the first optimization model or the second optimization model, each optimization solution comprising a total unassigned volume and a corresponding total distance travelled by a pull engine.

14. The method of claim 8, further comprising displaying, on the electronic display:

a pull lead assignment chart that visually indicates a plurality of build times for the plurality of train blocks, at least some of the plurality of classification tracks of the classification bowl, and one or more pull leads; and a track utilization graphic that visually indicates, for each of at least some of the plurality of classification tracks of the classification bowl, an assigned train block volume, an unassigned train block volume, and an amount of remaining track footage.

15. One or more computer-readable non-transitory storage media embodying instructions that, when executed by a processor, cause the processor to spawn a first computer process configured to execute a first set of instructions from the instructions to perform a first set of operations for assigning train blocks at a railroad merchandise yard and to spawn a second computer process configured to execute a second set of instructions from the instructions to perform a second set of program steps for the assigning train blocks at the railroad merchandise yard, wherein the first computer process and the second computer process are spawned concurrently, and wherein operations of the first set of operations and the second set of operations include:

accessing historical train block volume data;

determining, using a first optimization model and the historical train block volume data, a first list of train block assignments for a plurality of train blocks and a plurality of classification tracks of a classification bowl;

determining whether a volume of the plurality of train blocks is greater than a total available track length of the plurality of classification tracks;

in response to determining that the volume of the plurality of train blocks is not greater than the total available track length of the plurality of classification tracks, displaying the first list of train block assignments generated by the first optimization model on an electronic display; and in response to determining that the volume of the plurality of train blocks is greater than the total available track length of the plurality of classification tracks:

determining, using a second optimization model and the historical train block volume data, a second list of train block assignments for the plurality of train blocks and the plurality of classification tracks; and displaying the second list of train block assignments generated by the second optimization model on the electronic display.

16. The one or more computer-readable non-transitory storage media of claim 15, wherein the first optimization model:

minimizes an amount of total distance a plurality of pull engines must travel to build a plurality of outbound trains;

minimizes a total number of conflicting pull leads;

minimizes a total number of outbound trains present in multiple pull-leads; and minimizes a number of swing tracks assigned in between train blocks belonging to a same outbound train.

17. The one or more computer-readable non-transitory storage media of claim 15, wherein the second optimization model:

minimizes an amount of total distance a plurality of pull engines must travel to build a plurality of outbound trains;

minimizes a total number of conflicting pull leads;

minimizes a total number of outbound trains present in multiple pull-leads; and minimizes a volume of unassigned train blocks.

18. The one or more computer-readable non-transitory storage media of claim 15, wherein the historical train block volume data comprises a predetermined percentile of daily train block volumes over a predetermined number of preceding days.

19. The one or more computer-readable non-transitory storage media of claim 15, wherein the first list of train block assignments and the second list of train block assignments each indicate an assigned classification track of the plurality of classification tracks for each train block of the plurality of train blocks.

20. The one or more computer-readable non-transitory storage media of claim 15, the operations further comprising displaying, on the electronic display:

a pareto chart that illustrates various optimization solutions according to either the first optimization model or the second optimization model, each optimization solution comprising a total unassigned volume and a corresponding total distance travelled by a pull engine;

a pull lead assignment chart that visually indicates a plurality of build times for the plurality of train blocks, at least some of the plurality of classification tracks of the classification bowl, and one or more pull leads; and a track utilization graphic that visually indicates, for each of at least some of the plurality of classification tracks of the classification bowl, an assigned train block volume, an unassigned train block volume, and an amount of remaining track footage.

* * * * *